US007485002B2

(12) United States Patent
Nishide et al.

(10) Patent No.: US 7,485,002 B2
(45) Date of Patent: Feb. 3, 2009

(54) SHIELDED CONNECTOR AND SHIELDING SHELL

(75) Inventors: Satoru Nishide, Yokkaichi (JP); Masahiro Noda, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/940,529

(22) Filed: Nov. 15, 2007

(65) Prior Publication Data

US 2008/0119087 A1 May 22, 2008

(30) Foreign Application Priority Data

Nov. 20, 2006 (JP) ..... 2006-312724
Feb. 22, 2007 (JP) ..... 2007-042235

(51) Int. Cl.
*H01R 13/648* (2006.01)

(52) U.S. Cl. ..... 439/609
(58) Field of Classification Search ..... 439/607, 439/609, 610
See application file for complete search history.

(56) References Cited

FOREIGN PATENT DOCUMENTS

JP 8-88050 4/1996
JP 11-265754 9/1999

*Primary Examiner*—Ross N Gushi
(74) *Attorney, Agent, or Firm*—Gerald E. Hespos; Anthony J. Casella

(57) ABSTRACT

A shielding shell (30) of a male housing (10M) and a shielding shell (30) of a female housing (10F) have the same shape, touching portions (35) of the shielding shells (30) are such that outer touching pieces (32) having contact points at the inner sides and inner touching pieces (31) having contact points at the outer sides are arranged in circumferential direction, and the inner touching pieces (31) of one shielding shell (30) and the outer touching pieces (32) of the other shielding shell (30) correspond to and come into contacting with each other in radial directions. Since the shielding shell (30) of the male housing (10M) and that of the female housing (10F) have the same shape, cost can be reduced.

14 Claims, 22 Drawing Sheets

SHIELDED CONNECTOR AND SHIELDING SHELL

BACKGROUND OF THE INVENTION

1. Field of the Invention

The invention relates to a shielded connector and to a shielding shell.

2. Description of the Related Art

Japanese Unexamined Patent Publication No. H11-265754 discloses a shielded connector in which shielding shells are provided in a male housing and a female housing that are connectable with each other. The shielding shells connect when the housings are connected with each other to shield an electrically conducting path in the housings. However, the shielding shell of the male housing is configured differently than the shielding shell of the female housing. Thus, the above-described connector requires two kinds of shielding shells, leading to increased production costs.

Japanese Unexamined Patent Publication No. H08-88050 discloses a shielded connector with a female housing that has a terminal accommodating portion and a male housing that has a receptacle. A tubular shielding shell is mounted on the outer peripheral surface of the terminal accommodating portion of the female housing and a mating shell is provided in the male housing. The shielding shell of the female housing is connected with the mating shell by fitting the receptacle of the male housing on the terminal accommodating portion. More particularly, the mating shell of the male housing is inserted into a clearance between the outer peripheral surface of the terminal accommodating portion and the inner peripheral surface of the shielding shell. However, the leading end of the shielding shell is distanced from the outer peripheral surface of the terminal accommodating portion in this construction. Thus, the leading end of the receptacle might interfere with the leading end of the shielding shell if the axial lines of the male and female housings are inclined during connection. This interference could inadvertently deform the shielding shell.

The invention was developed in view of the above situation and an object thereof is to improve operability.

SUMMARY OF THE INVENTION

The invention relates to a shielded connector with male and female housings that are connectable with each other. A tubular shielding shell is provided in each of the housings. Touching portions at the leading ends of the shielding shells connect when the male and female housings are connected, and thereby shield an electrically conducting path in the male and female housings. The touching portion of the shielding shell of the male housing has at least one outer touching piece with a contact point at the inner side and at least one inner touching piece with a contact point at the outer side. The shielding shell of the female housing has the same shape as the shielding shell of the male housing and the outer and inner touching pieces thereof are positioned circumferentially to contact the inner and outer touching pieces of the shielding shell of the male housing substantially in directions substantially normal to the connecting direction of the two housings.

Efficiency is improved and production and handling costs are reduced because the shielding shells of the male and female housings have the same shape.

Two outer touching pieces and two inner touching pieces preferably are arranged alternately at intervals of about 90°. Thus, the shielding shells can be oriented so that the two outer touching pieces of a first of the shielding shells engage and radially press the two inner touching pieces of a second of the shielding shells. Simultaneously, the two outer touching pieces of the second shielding shell engage and radially press the two inner touching pieces of the first shielding shell. Additionally, the pressing directions of the touching pieces are shifted by about 90°. Thus, there is no likelihood that the touching portions of the male and female housings are displaced in radial directions, and a contact state of the touching portions of the shielding shells is stabilized.

The touching portion of the shielding shell of the male housing preferably projects forward from a surface of the male housing substantially facing the female housing and is at least partly surrounded by a receptacle of the male housing.

Ribs preferably are formed on the inner circumferential surface of the receptacle and extend along the outer surfaces of the outer touching pieces. The ribs support the outer touching pieces of the male housing against radially outward reaction forces exerted by the inner touching pieces of the female housing. Thus, sufficient contact pressure can be ensured for the touching pieces.

Slits preferably are provided to make the inner touching pieces resiliently deformable in radial directions independently of the outer touching pieces.

The shielded connector preferably has a substantially tubular female shielding shell that extends along the outer circumferential surface of a terminal accommodating portion. The male housing preferably has a receptacle configured to fit on the terminal accommodating portion. A male shielding shell is provided in the receptacle and is inserted in a clearance between the outer circumferential surface of the terminal accommodating portion and the inner circumferential surface of the female shielding shell to connect with the female shielding shell. The terminal accommodating portion preferably has at least one protection wall located before the front end of the female shielding shell. The protection wall is formed with at least one insertion hole for permitting entry of the male shielding shell. The protection wall prevents the female shielding shell from being deformed by the receptacle.

The outer circumferential surface of the protection wall preferably slides in contact with the inner circumferential surface of the receptacle in the process of connecting the male and female housings to prevent the housings from shaking in radial directions.

The inner circumferential surface of the receptacle and the outer circumferential surface of the female shielding shell preferably are held in contact in substantially radial directions when the male and female housings are connected. Thus, the receptacle prevents a radially outward displacement of the female shielding shell when the two housings are connected and ensures a sufficient contact pressure between the male and female shielding shells.

At least one seal preferably is mounted on the terminal accommodating portion behind a contact position of the female and male shielding shells and more radially outward than the outer circumferential surface of the protection wall. At least one rib is formed at a position of the inner circumferential surface of the receptacle behind a close contact position with the seal and can slide in contact with the outer circumferential surface of the protection wall. The inner circumferential surface of the receptacle closely contacts the seal arranged more radially outward than the outer circumferential surface of the protection wall. Thus, a contact area of the inner circumferential surface of the receptacle with the protection wall is radially more inward than the close contact position with the seal. However, the rib is formed on the contact area with the protection wall. Therefore, the inner circumferential surface of the receptacle is held in contact with the outer circumferential surface of the protection wall via the rib. Further, there is no likelihood of causing deformations called sinks in the receptacle during the molding since the rib is formed instead of increasing the thickness of the receptacle to hold the inner circumferential surface of the receptacle in contact with the outer circumferential surface of the protection wall.

A front end portion of the female shielding shell preferably serves as a contact portion with the male shielding shell, and the protection wall is formed with at least one pushing portion for contacting the outer circumferential surface of the front end portion of the female shielding shell. The contact portion of the female shielding shell is displaced by the pushing portion to escape radially outward. Thus, a sufficient contact pressure can be ensured between the female and male shielding shells.

The inner touching pieces and the outer touching pieces preferably are arranged substantially symmetrically with respect to an axis of symmetry normal to the connecting direction of the two housings so that outer and inner touching pieces of the female housing can be positioned in circumferential direction to contact with the inner and outer touching pieces of the shielding shell of the male housing substantially in radial directions.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
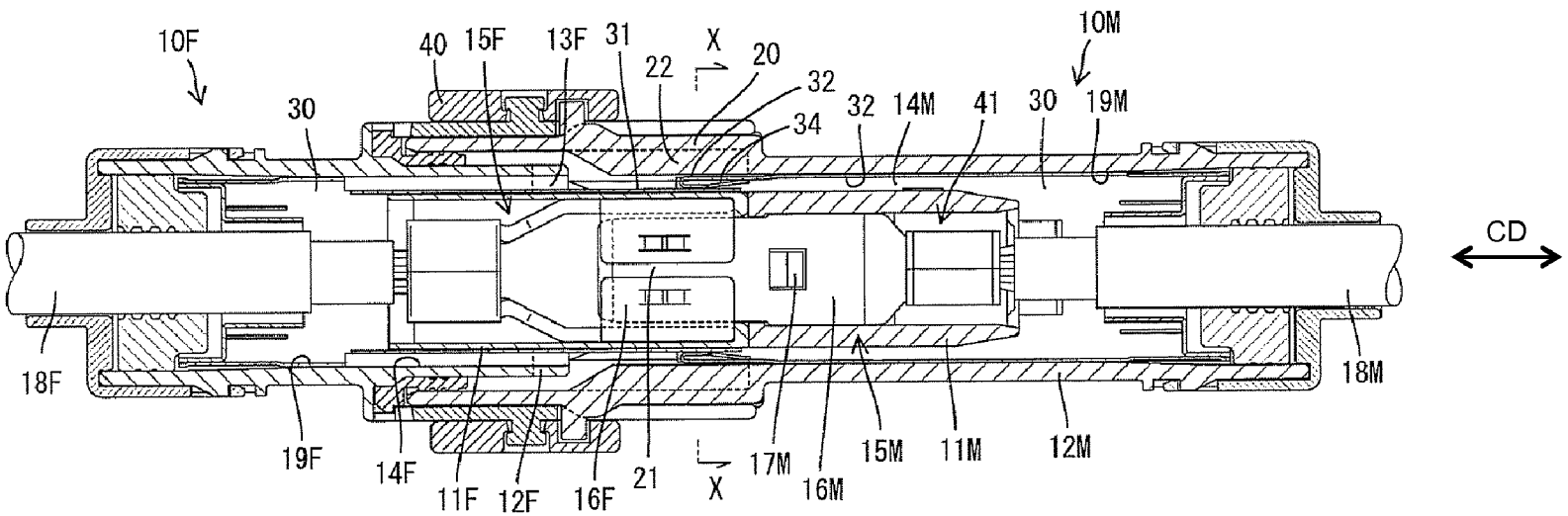
FIG. 1 is a horizontal section showing a state where male and female housings are connected in a first embodiment.
Figure 2:
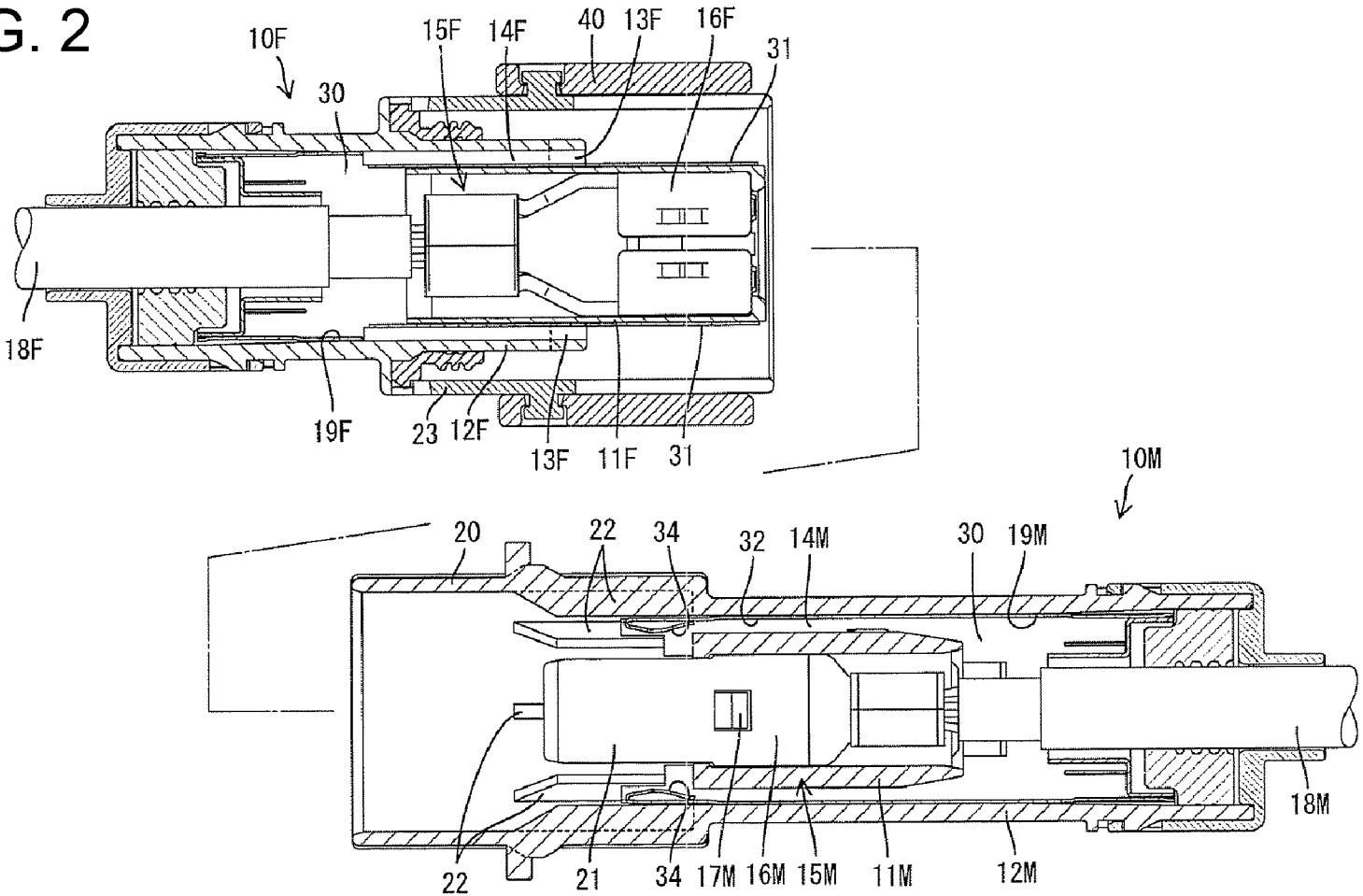
FIG. 2 is a horizontal section showing a state where the male and female housings are separated.
Figure 3:
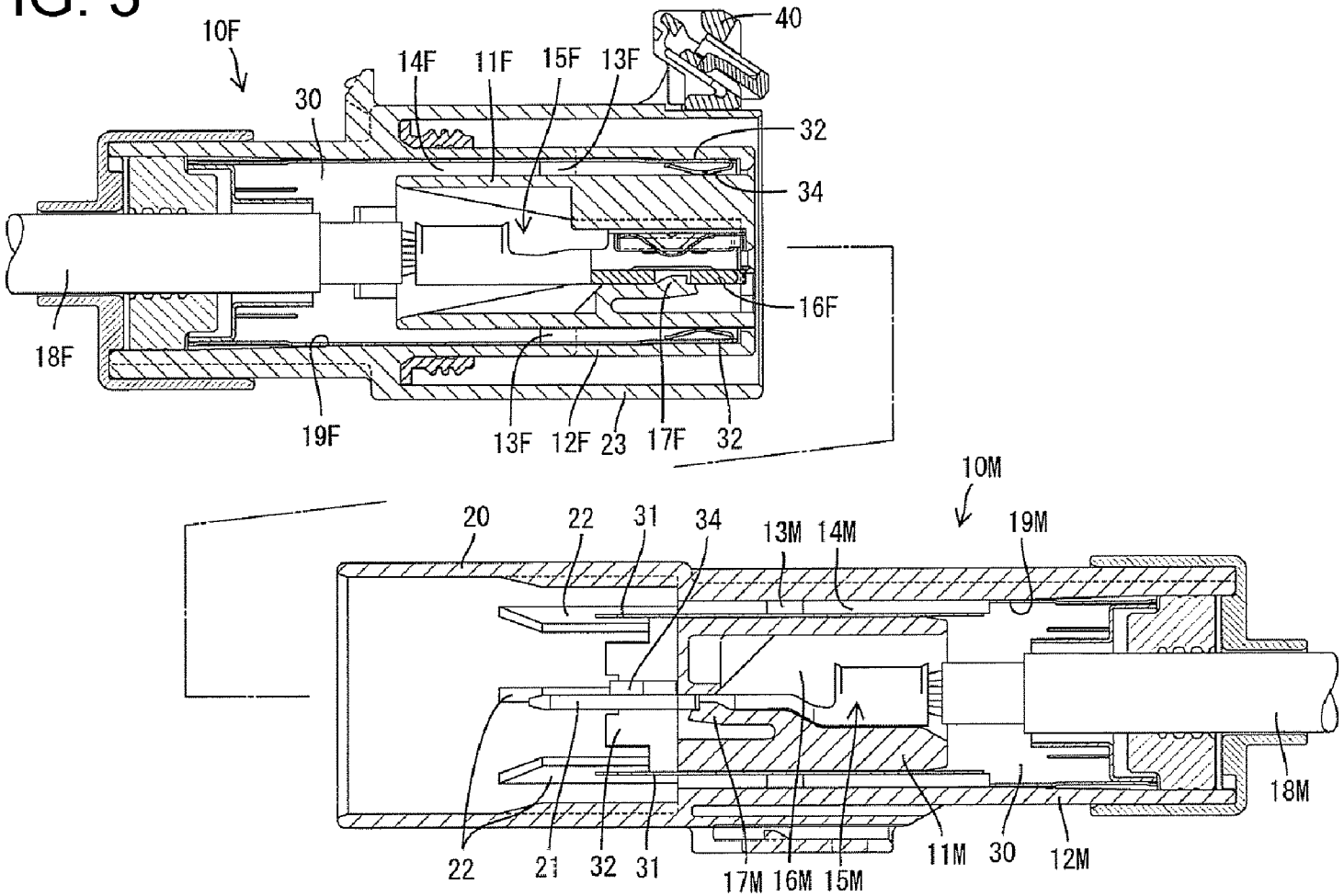
FIG. 3 is a vertical section showing the state where the male and female housings are separated.
Figure 4:
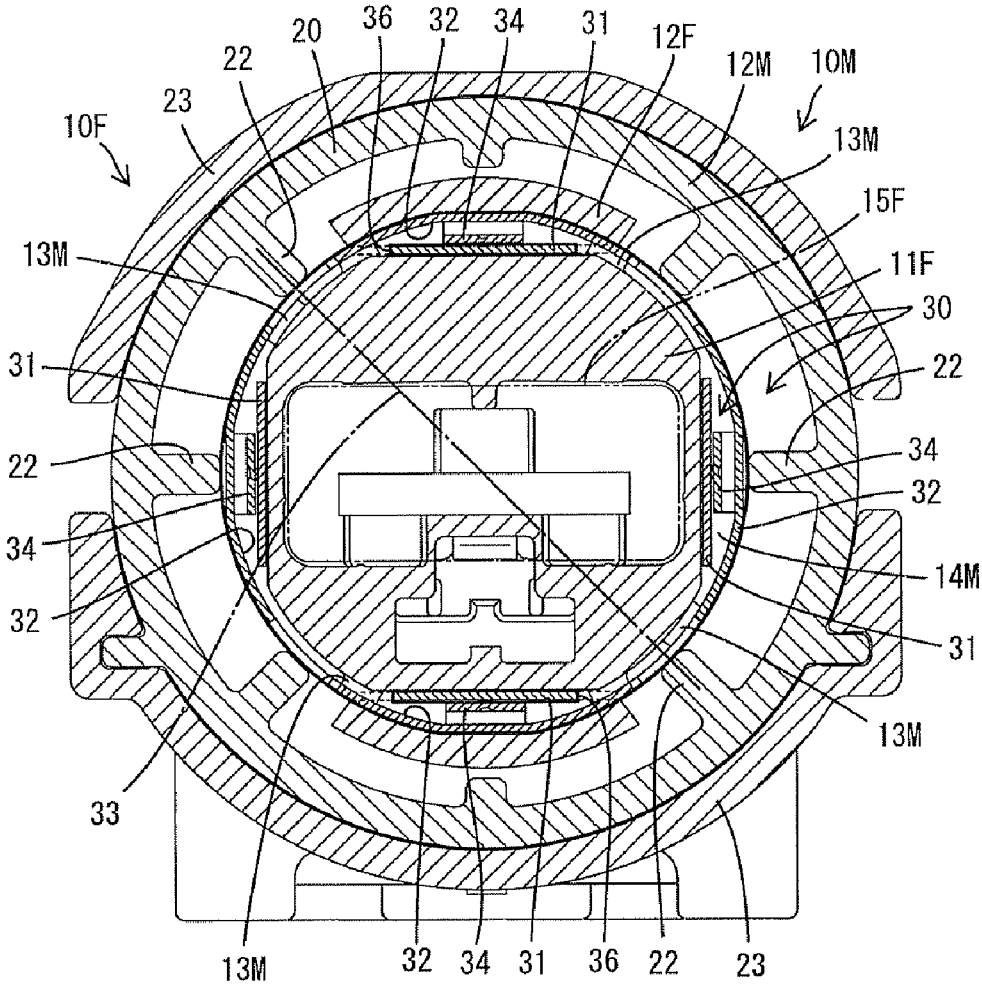
FIG. 4 is a section along X-X of FIG. 1.
Figure 5:
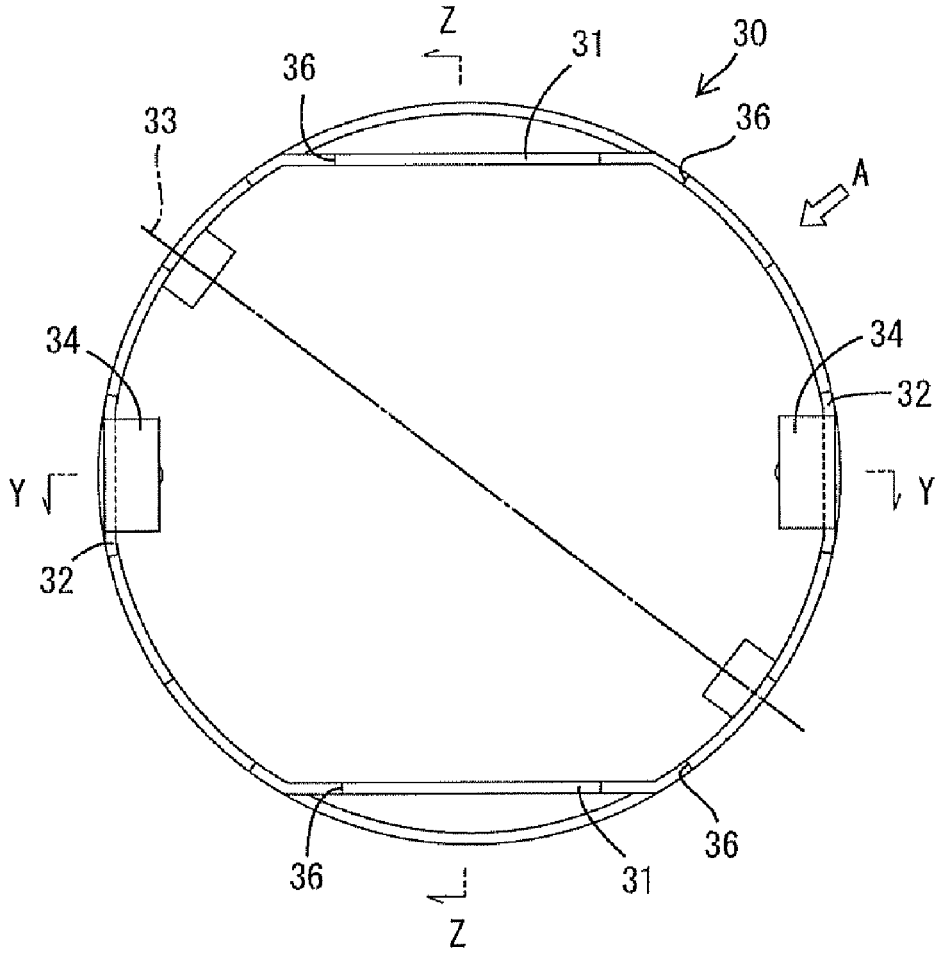
FIG. 5 is a front view of a shielding shell.
Figure 6:
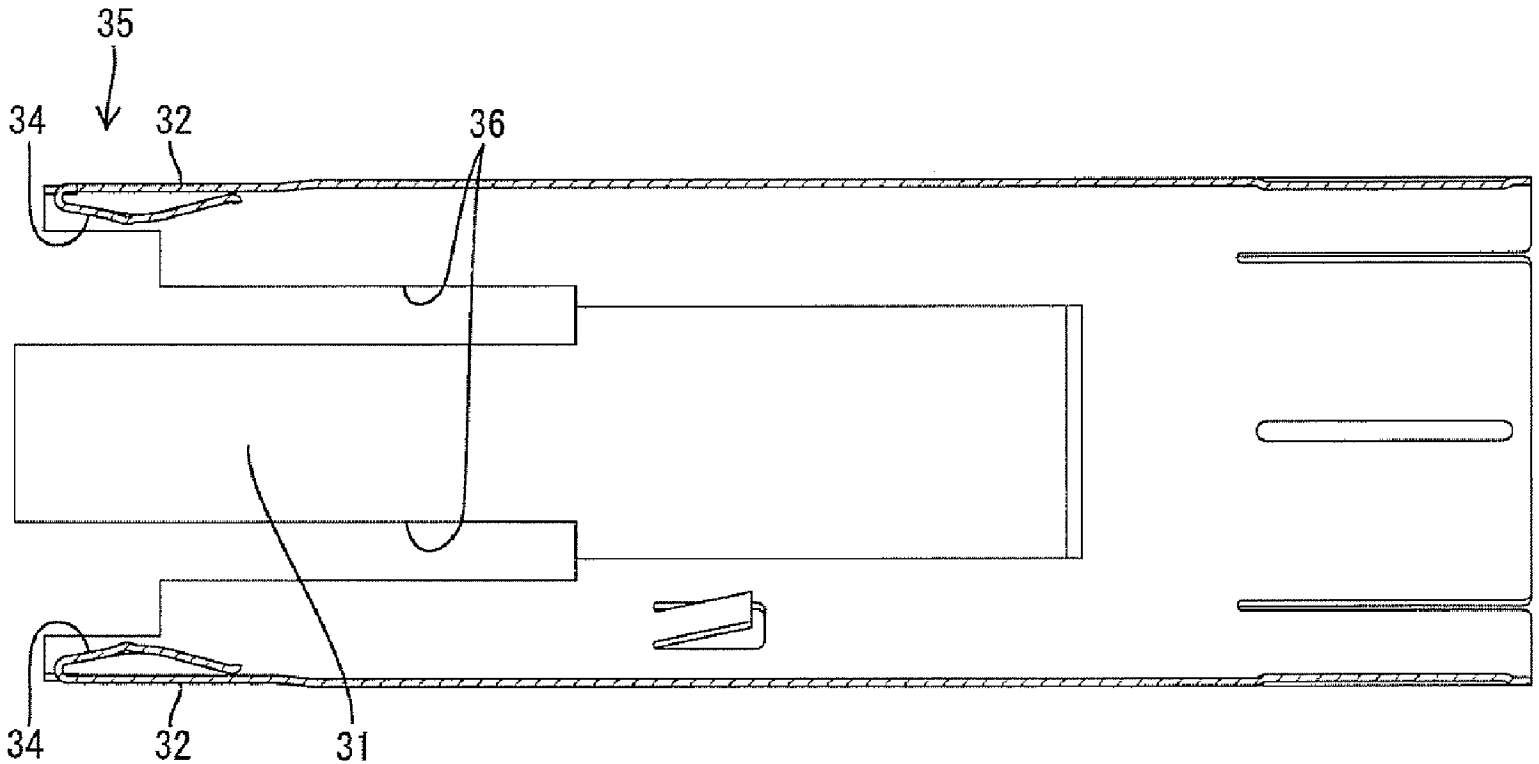
FIG. 6 is a section along Y-Y of FIG. 5.
Figure 7:
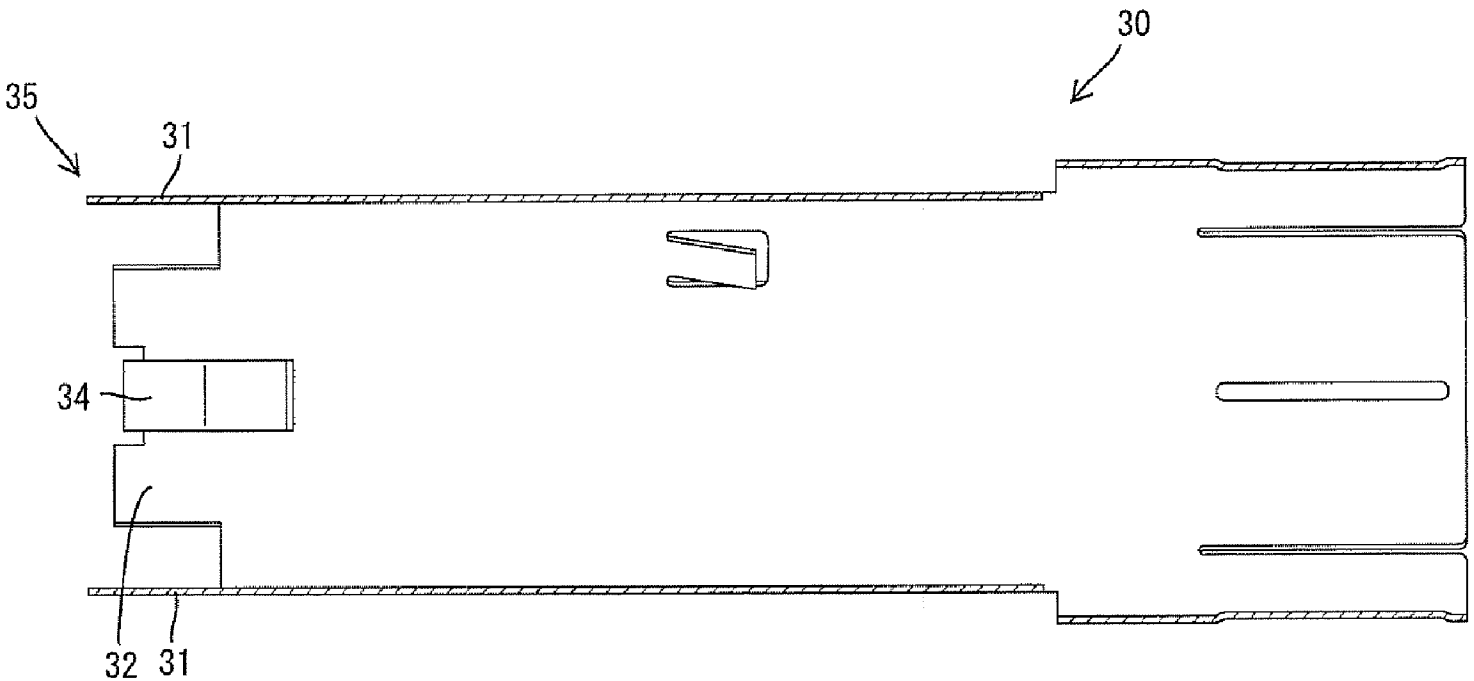
FIG. 7 is a section along Z-Z of FIG. 5.
Figure 8:
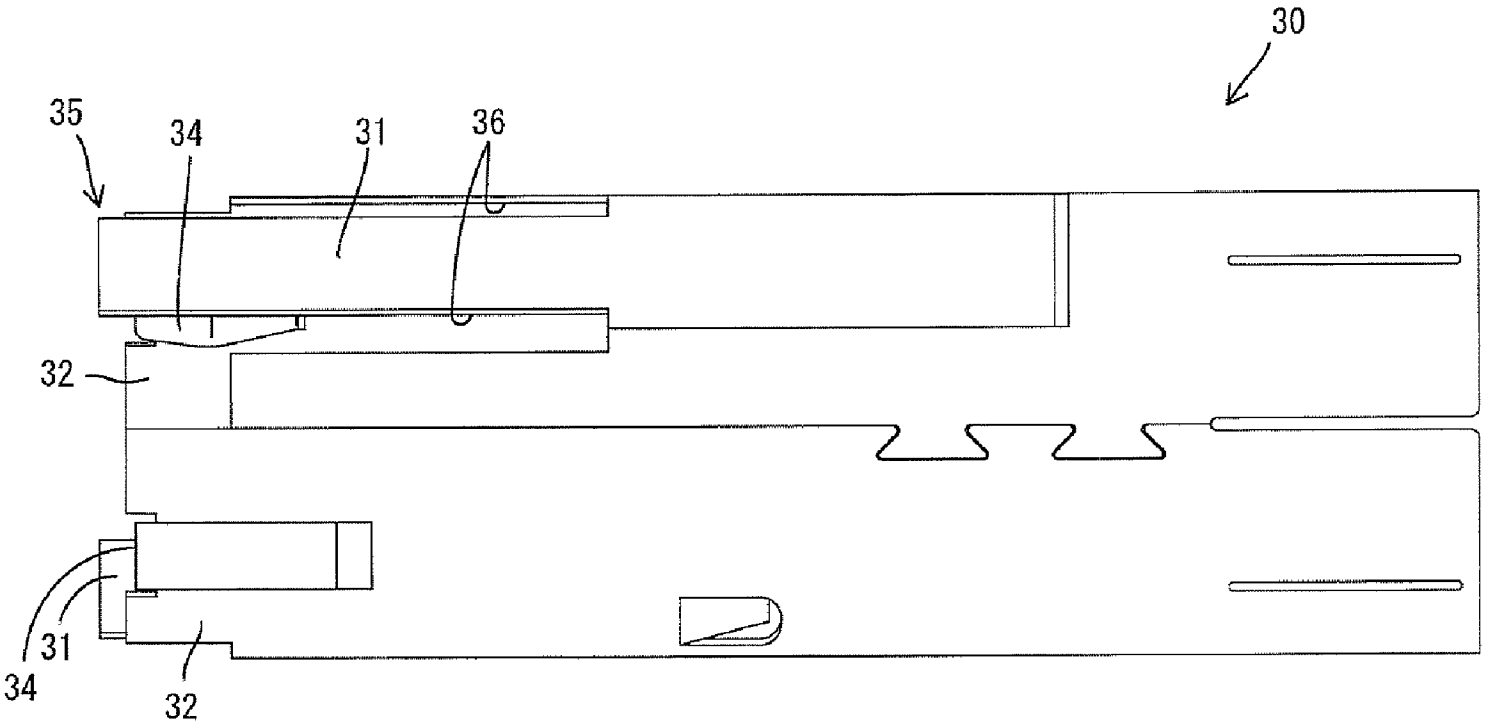
FIG. 8 is a view from an direction of arrow A in FIG. 5.
Figure 9:
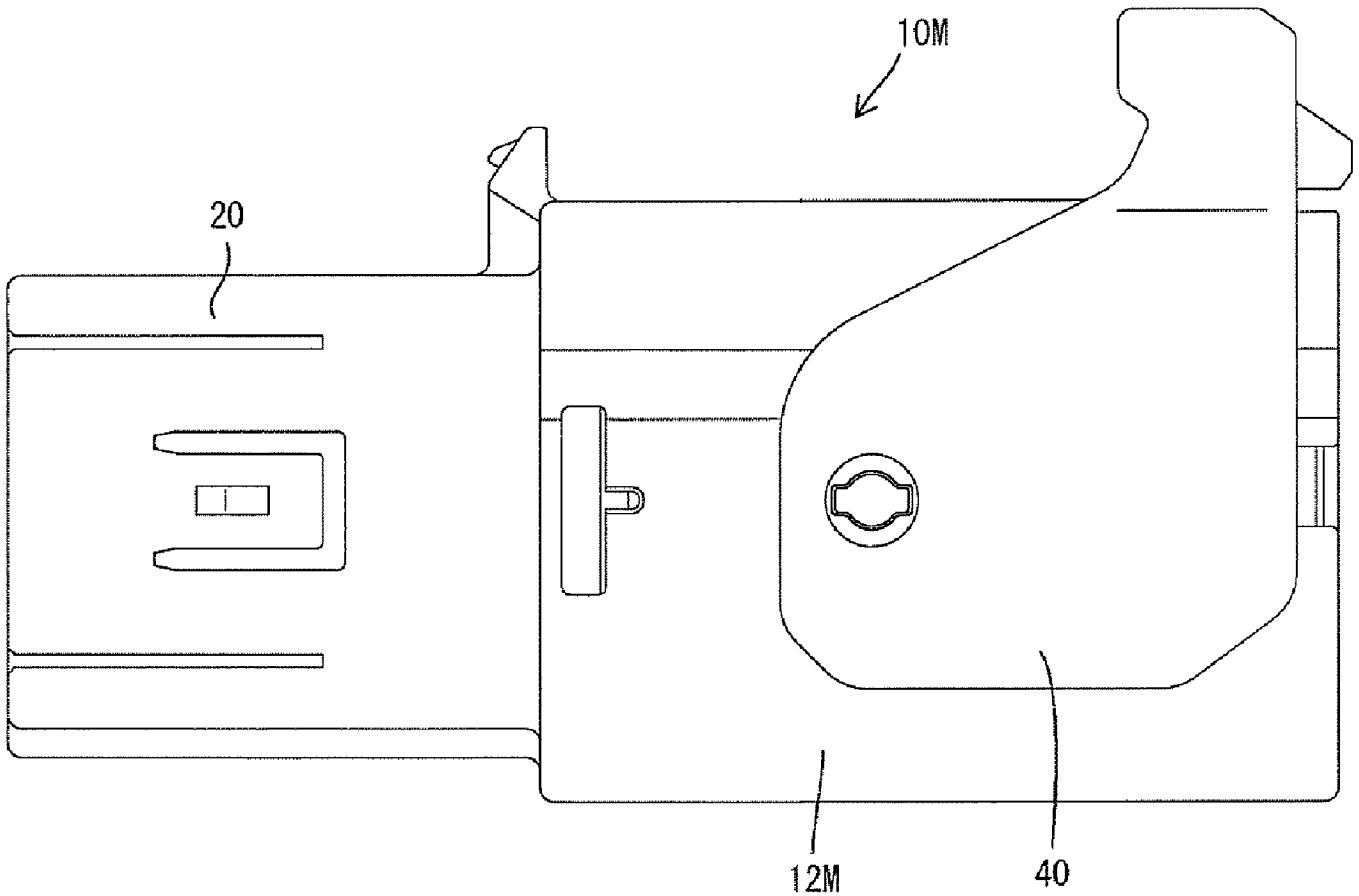
FIG. 9 is a side view of the male housing.
Figure 10:
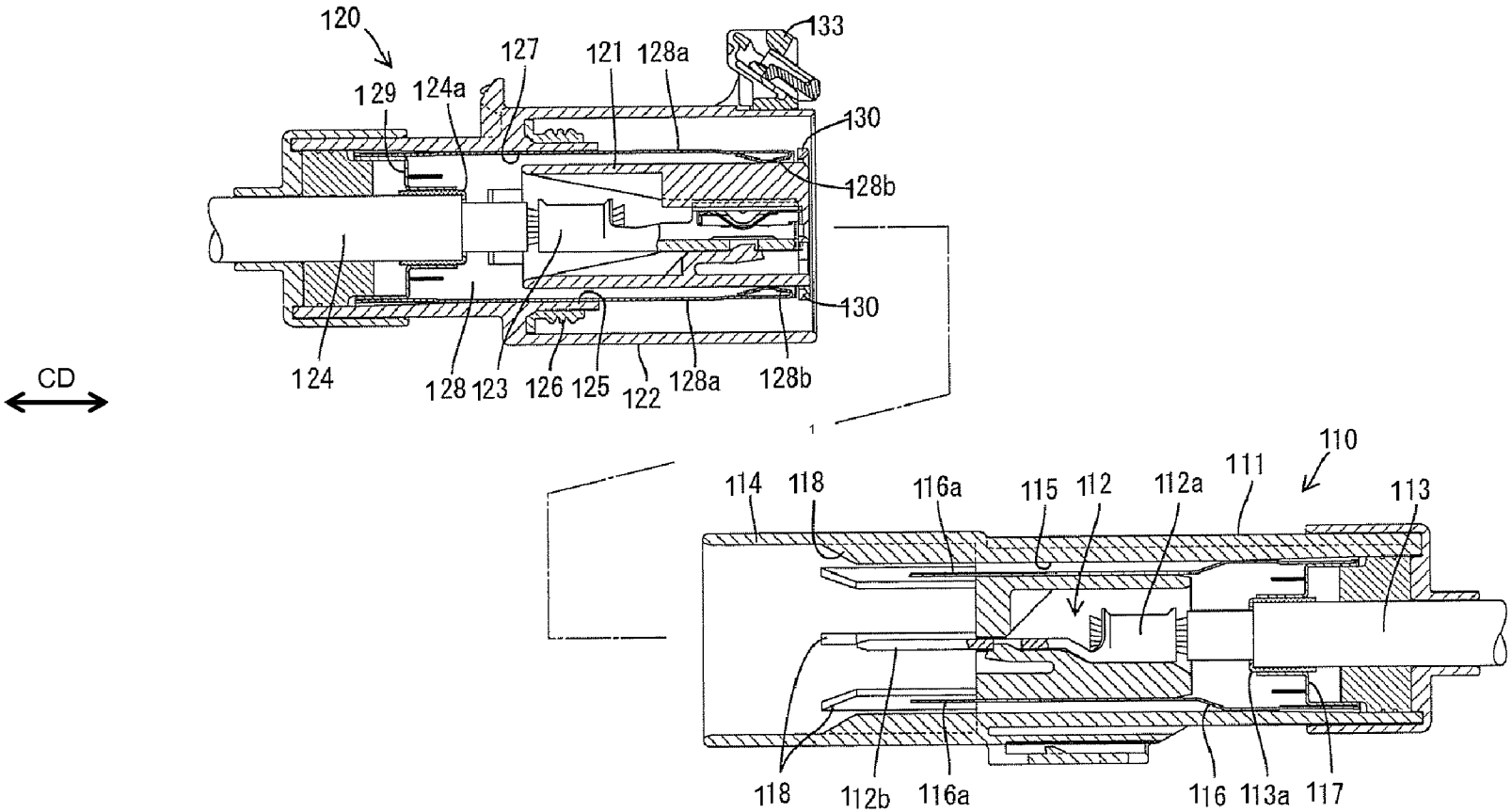
FIG. 10 is a section showing a state where two male and female housings are separated in a second embodiment.
Figure 11:
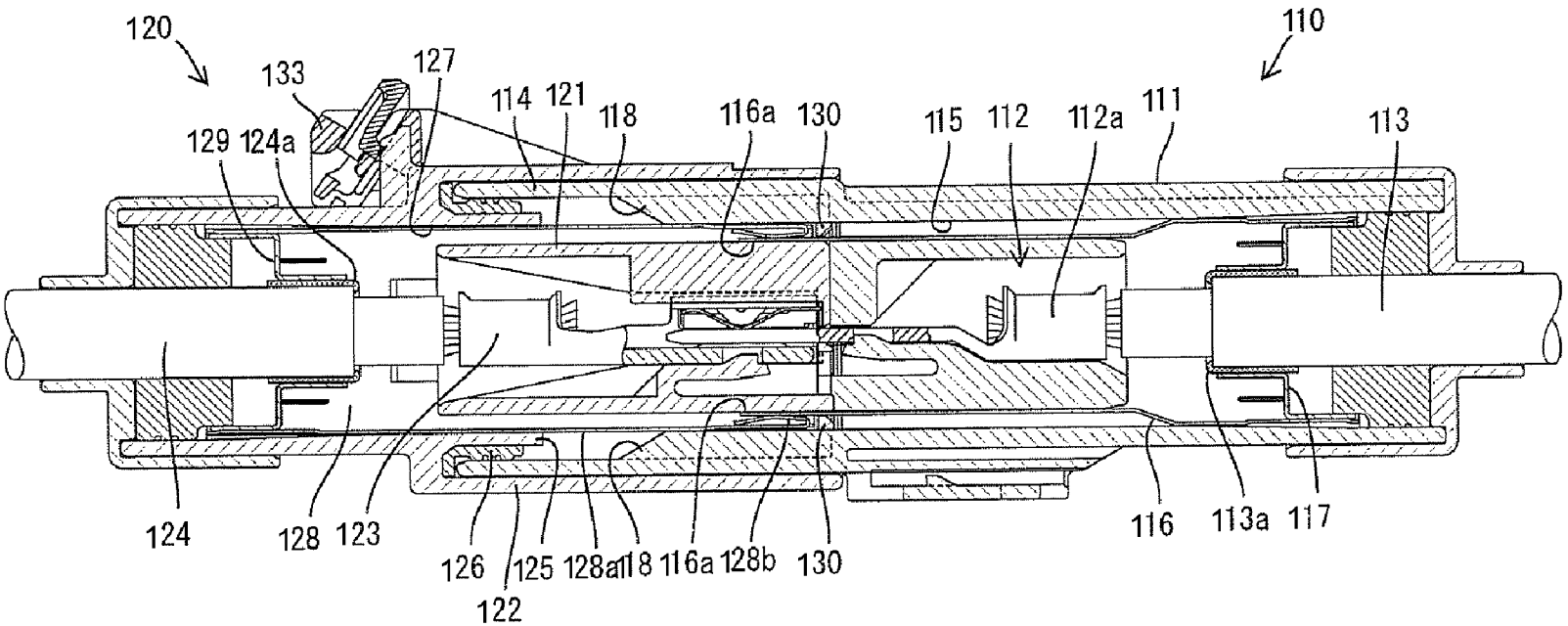
FIG. 11 is a section showing a state where the two housings are connected.
Figure 12:
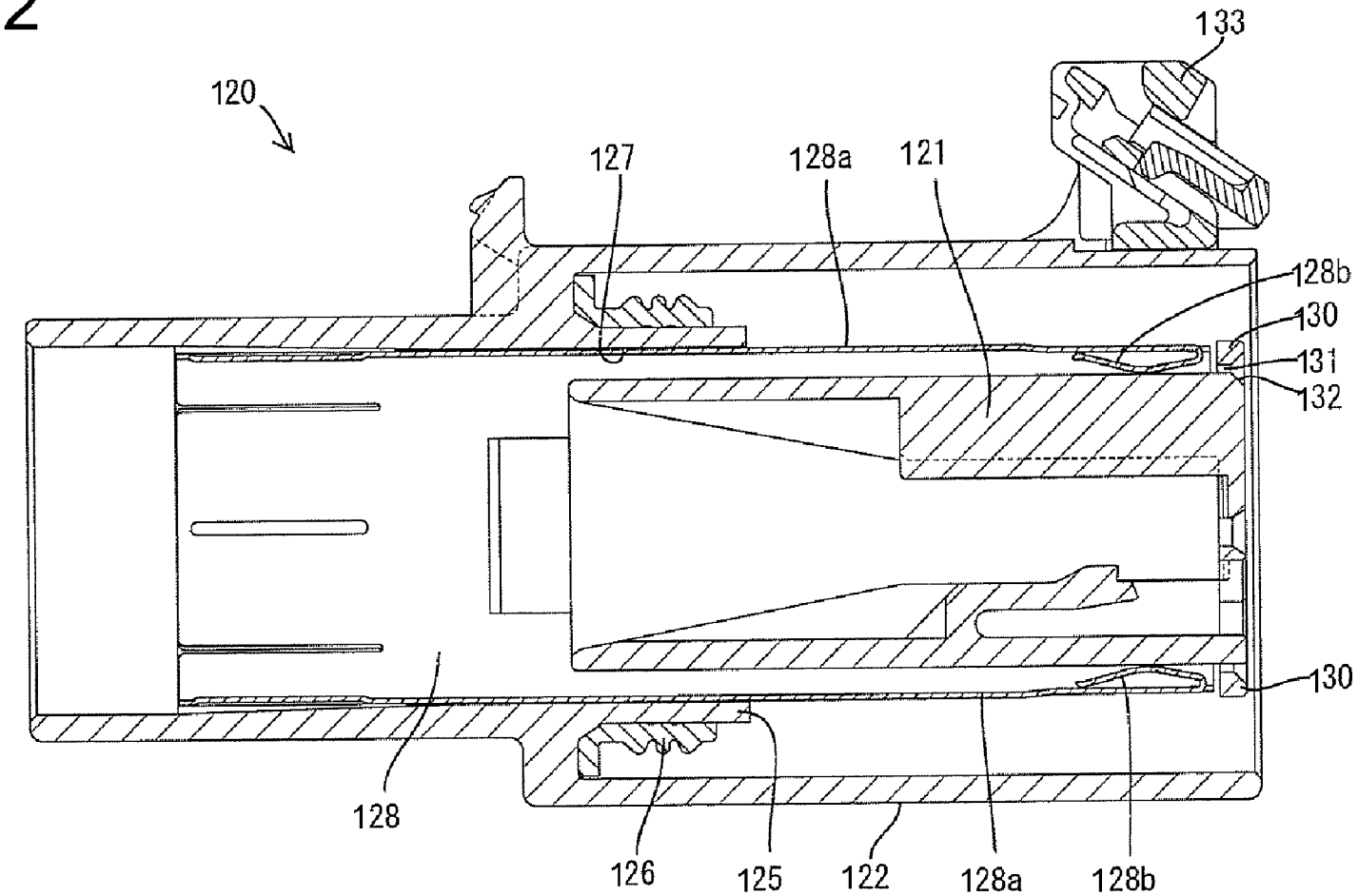
FIG. 12 is a section of the female housing.
Figure 13:
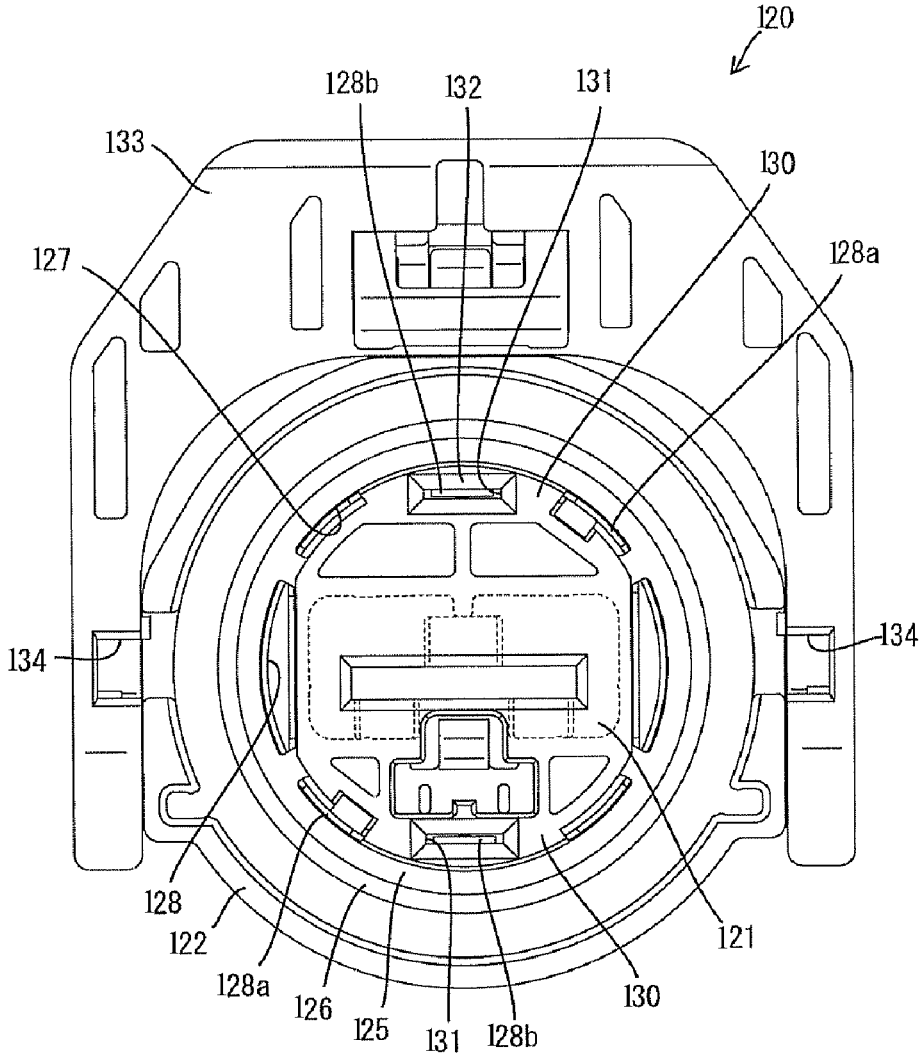
FIG. 13 is a front view of the female housing.
Figure 14:
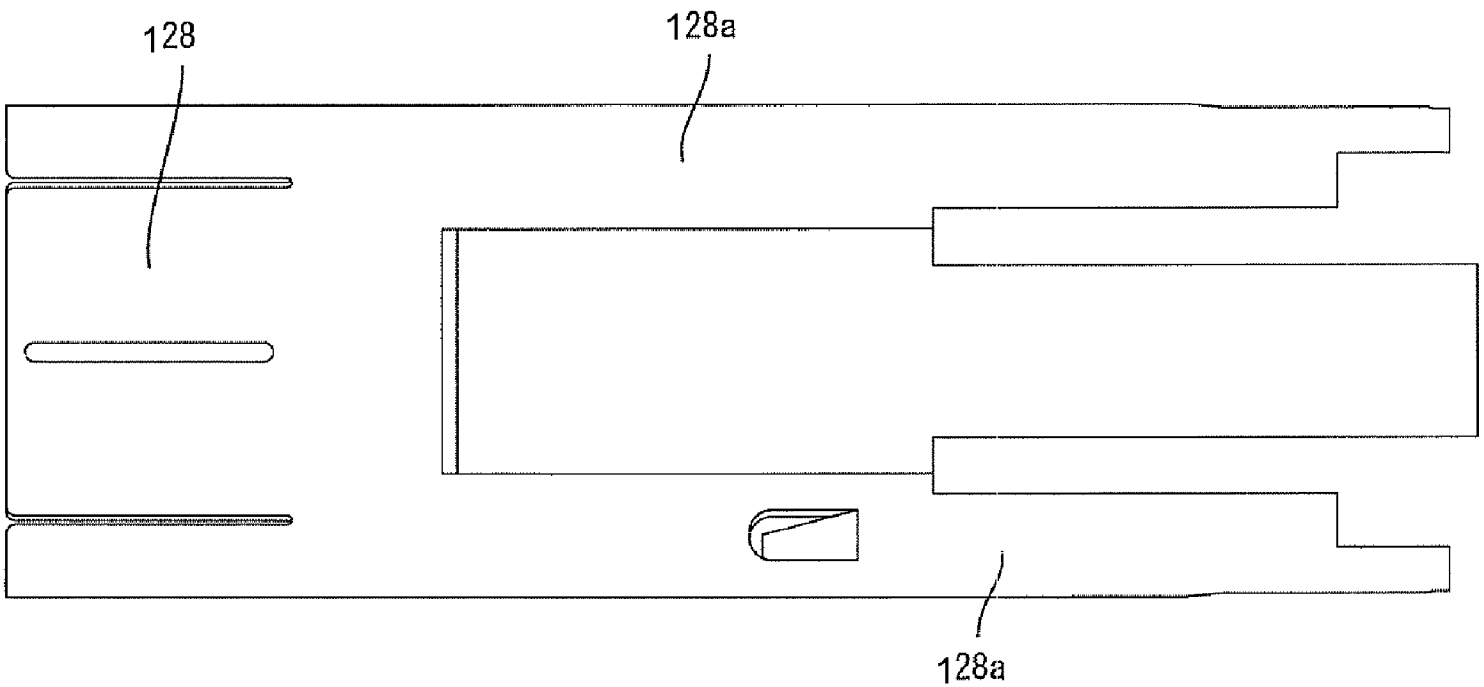
FIG. 14 is a side view of a female shielding shell.
Figure 15:
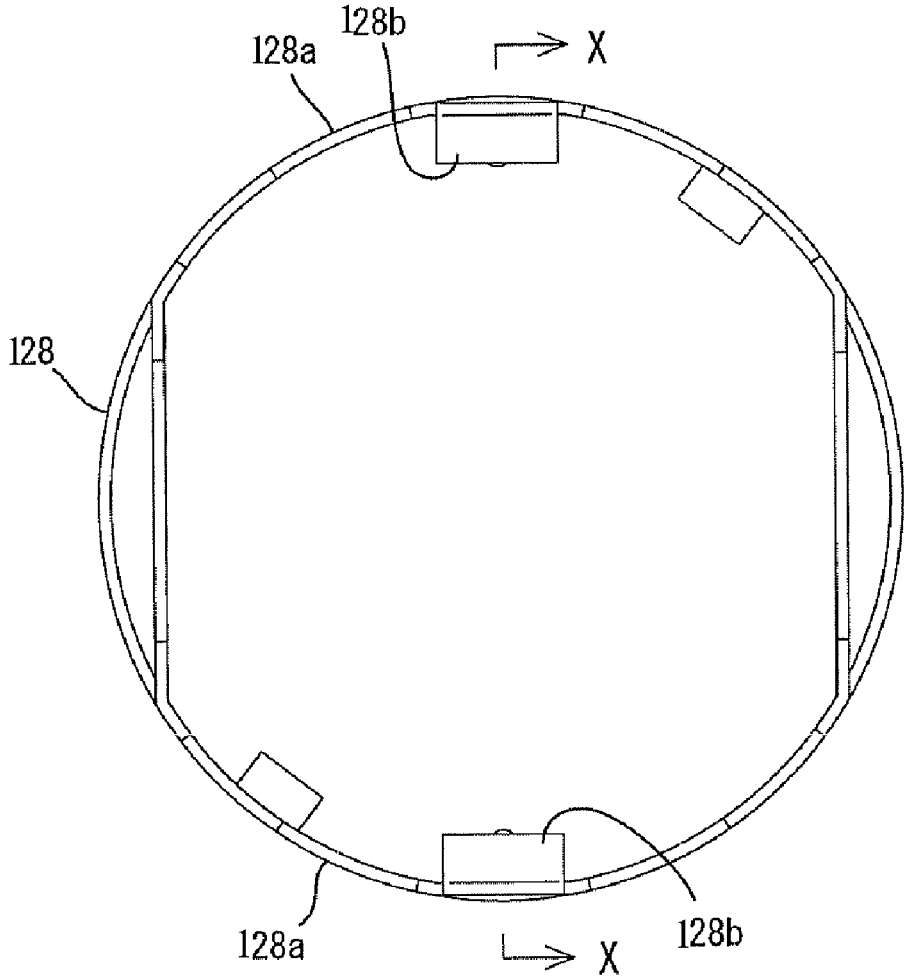
FIG. 15 is a front view of the female housing.
Figure 16:
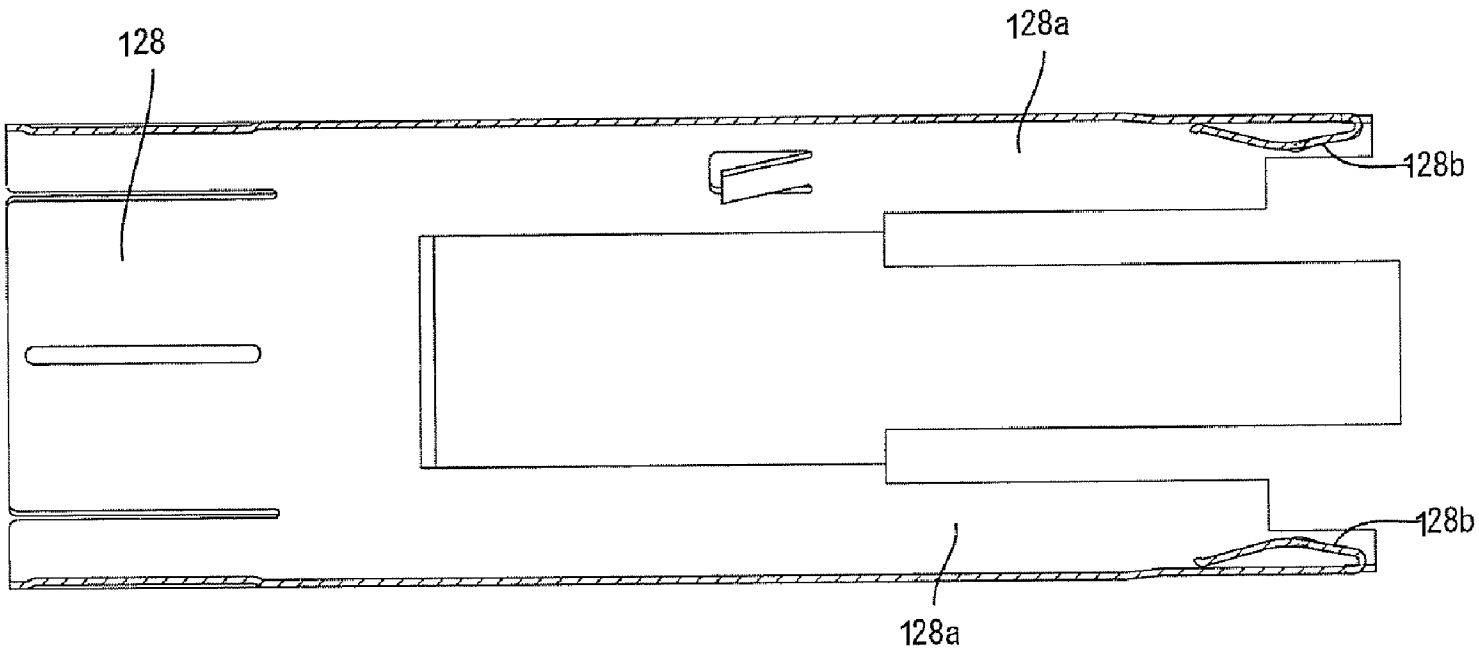
FIG. 16 is a section along X-X of FIG. 6.

A shielded connector according to a first embodiment of the invention is described with reference to FIGS. 1 to 8. The shielded connector of this embodiment has a male housing 10M and a female housing 10F. The male housing 10M is made e.g. of a synthetic resin and includes an inner housing 11M and an outer housing 12M at least partly surrounding the inner housing 11M. The inner and outer housings 11M and 12M have substantially circular cross sections and are arranged so that the outer circumferential surface of the inner housing 11M and the inner circumferential surface of the outer housing 12M are connected by four connecting portions 13M that are spaced circumferentially apart at substantially equal intervals of about 90°. A substantially cylindrical mount space 14M is formed in a clearance between the outer circumferential surface of the inner housing 11M and the inner circumferential surface of the outer housing 12M. The four connecting portions 13M are arranged at 45° positions with respect to vertical and transverse lines, i.e. at right upper, left upper, right lower and left lower positions.

A main portion 16M of a male terminal fitting 15M is inserted into the inner housing 11M from behind and is retained by a lock 17M. A cable 18M is connected with the rear end of the male terminal fitting 15M and passes through a back space 19M of the outer housing 12M behind the inner housing 11M to be drawn out of male housing 10M.

A substantially cylindrical receptacle is defined in an area of the outer housing 12M before the inner housing 11M. A long narrow tab 21 at the front end of the male terminal fitting 15M projects into the receptacle 20 from the front end surface of the inner housing 11M. Ribs 22 are formed on the inner circumferential surface of the receptacle 20. The ribs 22 extend forward from the back end of the receptacle 20 to a longitudinal intermediate position thereof and are aligned parallel to a connecting direction CD of the two housings 10M, 10F. Additionally, the ribs 22 are spaced apart circumferentially at substantially even intervals.

A shielding shell 30 is to be mounted into the male housing 10M. The shielding shell 30 is formed by bending, folding and/or embossing a conductive metal plate material punched or cut into a specified shape and has a substantially tubular shape as a whole. A rear end portion of the shielding shell 30 is substantially cylindrical over the entire circumference. However, approximately the front two-thirds of the shielding shell 30, excluding the rear end portion, is formed with two substantially vertically symmetrical inner touching pieces 31 in the form of horizontal flat plates and two substantially bilaterally symmetrical arcuate outer touching pieces 32. The inner touching pieces 31 and the outer touching pieces 32 are arranged alternately in the circumferential direction at substantially even intervals of about 90°. Thus, even if the shielding shell 30 of the male housing 10M is turned 180° about a vertical axis or a transverse axis, the two inner touching pieces 31 will be arranged at the upper and lower sides and the two outer touching pieces 32 are arranged at the left and right sides. In other words, the inner touching pieces 31 and the outer touching pieces 32 are arranged substantially symmetrically with respect to an axis of symmetry normal to the connecting direction CD of the two housings 10M, 10F and connecting two diagonally arranged connecting portions 13M.

The leading end of the horizontal outer surface of each inner touching piece 31 defines a contact point for contacting the shielding shell 30 of the female housing 10F. On the other hand, cantilevered parts extend from the front edge of each outer touching piece 32 and are folded back and in to form resilient touching pieces 34. The inner surface of each resilient touching piece 34 serves as a contact point with the shielding shell 30 of the female housing 10F. The leading front ends of the two inner touching pieces 31 and the leading ends of the two outer touching pieces 32 form a touching portion 35 for contacting the shielding shell 30 of the female housing 10F. The adjacent inner and outer touching pieces 31, 32 are separated by slits 36 that extend straight back from the front end of the shielding shell 30. The slits 36 are formed along the opposite lateral edges of the inner touching pieces 31. Thus, the inner touching pieces 31 are resiliently deformable in radial directions independently of the outer touching pieces 32.

The shielding shell 30 is inserted into the outer housing 12M from behind so that the slits 36 engage the connecting portions 13M, and areas of the inner and outer touching pieces 31, 32, excluding front end portions, are accommodated in the mount space 14M. The rear end portion of the shielding shell 30 closely contacts the inner circumferential surface of the rear space 19M in the outer housing 12M behind the inner housing 11M. Additionally, the touching portion 35 is located before the inner housing 11M in the receptacle 20. The outer touching pieces 32 have their outer circumferential surfaces held in contact with the ribs 22 in radial directions, to prevent radially outward displacements thereof.

The female housing 10F is made e.g. of a synthetic resin and includes an inner housing 11F and an outer housing 12F surrounding the inner housing 11F. The outer circumferential surface of the inner housing 11F and the inner circumferential surface of the outer housing 12F have substantially circular cross sections and are connected by four connecting portions 13F that are spaced apart at substantially even intervals of about 90°. A substantially cylindrical mount space 14F is formed in a clearance between the outer circumferential surface of the inner housing 11F and the inner circumferential surface of the outer housing 12F. Further, the four connecting portions 13F are at positions spaced about 45° from vertical and transverse lines, i.e. at right upper, left upper, right lower and left lower positions.

A main portion 16F of a male terminal fitting 15F is inserted into the inner housing 11F from behind and is retained by a lock 17F in the inner housing 11F. A cable 18F connected with the rear end of the male terminal fitting 15F passes through a back space 19F of the outer housing 12F behind the inner housing 11F and is drawn out of the female housing 10F. A substantially tubular fitting 24 surrounds an area of the outer housing 12F corresponding to the inner housing 11F and has an open front end. The receptacle 20 of the male housing 10M is insertable into a clearance between the tubular fitting 24 and the outer housing 12F.

The shielding shell 30 of the female housing 10F has the same shape as the shielding shell 30 of the male housing 10M. The shielding shell 30 is mounted in the female housing 10F so that almost the entireties of the inner and outer touching pieces 31, 32 including front end portions are accommodated in the mount space 14F between the inner and outer 11F and housings 12F. Further, radially outward displacements of the outer touching pieces 32 are prevented by the contact of the outer circumferential surfaces of the touching pieces 32 with the inner circumferential surface of the outer housing 12F.

The two inner touching pieces 31 are arranged in the male housing 10M at the upper and lower sides and the two outer touching pieces 32 are arranged in the male housing 10M at the left and right sides in the shielding shell 30. However, the shielding shell 30 of the female housing 10F is mounted so that the two inner touching pieces 31 are arranged at the left and right sides and the two outer touching pieces 32 are arranged at the upper and lower sides. Specifically, the shielding shell 30 in the orientation of the shielding shell 30 of the male housing 10M is rotated 180° about a vertical axis and then is rotated about 90° in the circumferential direction to achieve the proper orientation for the shielding shell 30 of the female housing 10F.

The inner and outer touching pieces 31, 32 are arranged so that an axis of symmetry 33 of the shielding shell 30 of the female housing 10F is substantially coaxial to the axis of symmetry 33 of the shielding shell 30 of the male housing 10M. If the touching portions 35 at the front ends are opposed to each other that the both axes of symmetry 33 are substantially coaxial in this way, the inner touching pieces 31 of one shielding shell 30 correspond to the outer touching pieces 32 of the other shielding shell 30, and the outer touching pieces 32 of the one shielding shell 30 correspond to the outer touching pieces 31 of the other shielding shell 30.

The two housings 10M, 10F are connected by operating a lever 40 or other such movable member on one of the housings 10M, 10F. Connection by means of a movable member, such as the lever 40, is well known construction and is not described in detail. In the process of connecting the two housings 10M, 10F, the receptacle 20 enters the tubular fitting 24 and the front end portion of the shielding shell 30 of the male housing 10M enters the mount space 14F of the female housing 10F. The tab 21 of the male terminal fitting 15M enters the main portion 16F of the female terminal fitting 15F when the two housings 10M, 10F are connected properly and the two terminal fittings 15M, 15F are connected electrically. Further, the outer surfaces of the inner touching pieces 31 of the male housing 10M resiliently contact the inner surfaces of the resilient touching pieces 34 of the outer touching pieces 32 of the female housing 10F. Additionally, the inner surfaces of the resilient touching pieces 34 of the outer touching pieces 32 of the male housing 10M resiliently contact the outer surfaces of the inner touching pieces 31 of the female housing 10F. As a result, the touching portions 35 at the front ends of the both shielding shells 30 are connected electrically. In this way, the electrically conducting path 41 formed by the male terminal fitting 15M in the male housing 10M, the female terminal fitting 15F in the female housing 10F, an area of the cables 18M and 18 F accommodated respectively in the male and female housings 10M and 10F is substantially surrounded and shielded by the shielding shell 30 of the male housing 10M and the shielding shell 30 of the female housing 10F.

The shielding shells 30 are formed so that the outer touching pieces 32, with their contact points at the inner sides, and the inner touching pieces 31, with their contact points at the outer sides, are arranged circumferentially. Additionally, the outer and inner touching pieces 32, 31 of the shielding shell 30 of the female housing 10F respectively contact the inner and outer touching pieces 31, 32 of the shielding shell 30 of the male housing 10M in substantially radial directions and substantially normal to the connecting direction CD.

The shielding shells 30 are formed so that the outer and inner touching pieces 32, 31 are substantially symmetrically arranged with respect to the axes of symmetry 33 normal to the connecting direction CD of the two housings 10M, 10F, and the shielding shell 30 of the female housing 10F and the shielding shell 30 of the male housing 10M are arranged so that the axes of symmetry 33 thereof are substantially parallel to each other. Thus, the shielding shell 30 of the male housing 10M and the shielding shell 30 of the female housing 10F can have the same shape, and the cost for parts is reduced.

The two outer touching pieces 32 and the two inner touching pieces 31 are arranged alternately at intervals of about 90°. Thus, a positional relationship can be established in which the two outer touching pieces 32 of the one shielding shell 30 engage the two inner touching pieces 31 of the other shielding shell 30 while pressing them in radial directions and substantially normal to the connecting direction CD. Additionally, the two outer touching pieces 32 of the other shielding shell 30 engage the two inner touching pieces 31 of the one shielding shell 30 while pressing them in radial directions and substantially normal to the connecting direction CD. Further, the pressing directions are shifted circumferentially by about 90°. Thus, there is no likelihood that the touching portion 35 of the male housing 10M and that of the female housing 10F are displaced radially in vertical or transverse directions, and a contact state of the touching portions 35 of the shielding shells 30 is stabilized. Further, contact reliability is high since the four contact positions are ensured by the touching portions 35.

The touching portion 35 of the shielding shell 30 of the male housing 10M projects forward from a. back end surface of the receptacle 20 of the male housing 10M facing the female housing 10F, and is surrounded by the receptacle 20. Radially outward reaction forces acting on the outer touching pieces 32 of the male housing 10M from the inner touching pieces 31 of the female housing 10F are supported by the ribs 22 to ensure sufficient contact pressures for the touching pieces 31, 32.

A second embodiment of the invention is described with reference to FIGS. 9 to 16. A shielded connector of this embodiment is comprised of a male housing 110 and a female housing 120 connectable with and separable from each other along a connecting direction CD.

The male housing 110 is made e.g. of a synthetic resin, and has a substantially cylindrical housing main body 111 with an axial line that extends in forward and backward directions parallel to the connecting direction CD of the two housings 110, 120. A terminal main portion 112*a* of a male terminal fitting 112 is accommodated in the housing main body 111 and a shielded cable 113 connected with the rear end of the male terminal fitting 112 is drawn out backward from the housing main body 111. A substantially cylindrical receptacle 114 projects forward on the housing main body 111 and a tab 112*b* at the front end of the male terminal fitting 112 is accommodated in the receptacle 114. Circumferentially spaced mount holes 115 penetrate the housing main body 111 in forward and backward directions and a substantially cylindrical metallic male shielding shell 116 is mounted in the mount holes 115. A braided wire 113*a* of the shielded cable 113 is connected electrically with the rear end of the male shielding shell 116 via a tubular connecting member 117.

Upper and lower male touching pieces 116*a* are cantilevered forward on the male shielding shell 116. Each male touching piece 116*a* has a long narrow shape with a substantially constant width, and the extending direction of each male touching piece 116*a* is substantially parallel to connecting and separating directions of the two housings 110, 120. A touching portion is defined at the outer surface of the front end of each male touching piece 116*a* and projects into the receptacle 114 from the front end of the housing main body 111. The touching portion contacts a female shielding shell 128 as explained herein.

Ribs 118 are formed on the inner circumferential surface of the receptacle 114 and extend substantially straight in forward and backward directions. The ribs 118 are formed only in a rear portion of the receptacle 114, and neither the ribs 118 nor other protuberances are formed in a front portion of the receptacle 114.

The female housing 120 is an integral assembly made e.g. of a synthetic resin and includes a substantially cylindrical terminal accommodating portion 121 with an axis that extends in forward and backward directions and a substantially cylindrical tubular fitting 122 concentrically surrounding a front part of the terminal accommodating portion 121. The rear end of the tubular fitting 122 is connected with the outer circumferential surface of the terminal accommodating portion 121, while the front end of the tubular fitting 122 projects forward of the terminal accommodating portion 121. A female terminal fitting 123 is accommodated in the terminal accommodating portion 121, and a shielded cable 124 connected with the rear end of the female terminal fitting 123 is drawn backward from the terminal accommodating portion 121.

A tubular surrounding portion 125 is formed at the back end of the tubular fitting 122, and a ring-shaped seal 126 is to be mounted on the outer circumferential surface of the surrounding portion 125. The seal 126 is located radially more outward than the outer circumferential surface of the female shielding shell 128.

Circumferentially spaced mount holes 127 penetrate the terminal accommodating portion 121 in substantially forward and backward directions and the substantially cylindrical metallic female shielding shell 128 is mounted in the mount holes 127. A braided wire or shield film 124*a* of the shielded cable 124 is connected electrically connected with the rear end of the female shielding shell 128 via a tubular connecting member 129.

Upper and lower female touching pieces 128*a* are formed as cantilevers on the female shielding shell 128 and are curved plates with an arcuate shape substantially concentric with the terminal accommodating portion 121. The female touching pieces 128*a* extend forward along the outer circumferential surface of the terminal accommodating portion 121 substantially parallel to the connecting and separating directions of the two housings 110, 120, but are spaced from the outer circumferential surface of the terminal accommodating portion 121. A resiliently deformable contact portion 128*b* is folded back and inward from the front end of each female touching piece 128*a*. The contact portion 128*b* is narrower than the female touching piece 128*a* and is located substantially in the widthwise center of the female touching piece 128*a*. The width of the contact portion 128*b* preferably is substantially equal to the width of the male touching piece 116*a*. The inner surfaces of the contact portions 128*b* resiliently contact the outer circumferential surface of the terminal accommodating portion 121 when the two housings 110, 120 are separated. However, front end portions of the male touching pieces 116*a* are inserted into clearances between the contact portions 128*b* and the terminal accommodating portion 121 and the outer surfaces of the male touching pieces 116*a* and the inner surfaces of the contact portions 128*b* are electrically and resiliently in contact when the two housings 110, 120 are connected.

Upper and lower protection walls 130 are formed unitarily at the front end of the outer circumferential surface of the terminal accommodating portion 121. The protection walls 130 extend in a circumferential direction along the outer circumference of the front end of the terminal accommodating portion 21 to define substantially fan-shapes substantially concentric with the terminal accommodating portion 121. Additionally, the protection walls 130 are more forward than the contact portions 128*b* at the front ends of the female touching pieces 128*a*, and the front surfaces of the protection walls 130 are substantially continuous and flush with the front surface of the terminal accommodating portion 121. The protection walls 130 are circumferentially wider than the contact portions 128*b* and cover the contact portions 128*b* from front over substantially their entire widths. However, the female touching pieces 128*a* are wider than the protection walls 130 so that the opposite left and right edges of the female contact portions 128*a* protrude from the protection walls 130 (see FIG. 13).

The outer circumferential surfaces of these arcuate protection walls 130 have substantially the same radius of curvature as the outer circumferential surfaces of the arcuate female touching pieces 128*a*, and the outer circumferential surfaces of the protection walls 130 and those of the female touching pieces 128*a* overlap and are substantially flush with each other when viewed from the front. Specifically, a distance from the outer circumferential surface of the terminal accommodating portion 121 to those of the protection walls 130 substantially equals a distance from the outer circumferential surface of the terminal accommodating portion 121 to those of the female touching pieces 128*a*. Further, slit-like insertion holes 131 penetrate the protection walls 130 in forward and backward directions and can receive the male touching pieces 116*a*. Further, a guiding slant 132 is formed at the front opening edge of each insertion hole 131 where the male touching piece 116*a* is inserted.

To connect the male and females housing 110 and 120, the receptacle 114 is fit lightly into a cylindrical space between the terminal accommodating portion 121 and the tubular fitting 122. Cam followers (not shown) of known form project from the outer circumferential surface of the male housing 110 and are inserted into the entrances of cam grooves 134 of a lever 133 or other movable member mounted on the outer circumferential surface of the female housing 120. The lever 133 is rotated and the two housings 110, 120 are pulled towards each other and into a connected state by a cam action resulting from the engagement of the cam grooves 134 and the cam followers.

The receptacle 114 could enter the tubular fitting 122 obliquely in the process of connecting the two housings 110, 120. The female shielding shell 128 could be deformed inadvertently if the leading end of the receptacle 114 contacted the front end of the female shielding shell 128 (female touching pieces 128 and contact portions 128*b*). However, the protection walls 130 are provided before the female shielding shell 128. Thus, the receptacle 114 contacts the protection walls 130, but does not contact the front end of the female shielding shell 128 even if the leading end thereof heads toward the female shielding shell 128 from the front. The protection walls 130 prevent the deformation of the female shielding shell 128 caused not only by the receptacle 114, but also by external matter that might enter the tubular fitting 122.

The insertion holes 131 are formed in the protection walls 130 and the guiding slants 132 are formed at the opening edges of the insertion holes 131. Thus, there is no hindrance to an entering movement of the male shielding shell 116 into the clearance between the outer circumferential surface of the terminal accommodating portion 121 and the inner circumferential surface of the female shielding shell 128. Radial displacements of the male shielding shell 116 that has entered the insertion holes 131 are prevented. Hence, the male shielding shell 116 cannot contact the front end of the female shielding shell 128.

The ribs 118 formed on the inner circumferential surface of the receptacle 114 slide on the outer circumferential surfaces of the protection walls 130 in the process of connecting the two housings 110, 120. Thus, the two housings 110, 120 will not shake in radial directions.

The ribs 118 of the receptacle 114 and the outer circumferential surface of the front end of the female shielding shell 128 contact each other in radial directions when the male and female housings 110 and 120 are connected. Radially outward displacements of the contact portions 128*b* at the front end of the female shielding shell 128 are prevented by the contact with the receptacle 114. Thus, sufficient contact pressures is ensured between the contact portions 128*b* of the female shielding shell 128 and the male shielding shell 116 held in contact with the inner circumferential surfaces of the contact portions 128*b*.

The seal 126 is provided on the terminal accommodating portion 121 behind the contact position of the female shielding shell 128 and the male shielding shell 116 and more radially outward than the outer circumferential surfaces of the protection walls 130. Additionally, the inner circumferential surface of the leading end of the receptacle 114 closely contacts the outer circumferential surface of the seal 126. Thus, areas of the inner circumferential surface of the receptacle 114 in contact with the protection walls 130 (i.e. areas at the back end of the receptacle 114) are more radially inward than the close contact position of the receptacle 114 with the seal 126 (i.e. leading end of the receptacle 114). Accordingly, the ribs 118 are formed in the contact area with the protection walls 130 on the inner circumferential surface of the receptacle 114, and the inner circumferential surface of the receptacle 114 is held in contact with the outer circumferential surface of the protection walls 130 via the ribs 118.

It may be thought to increase the thickness of the receptacle 114 to hold the inner circumferential surface of the receptacle 114 in contact with the outer circumferential surfaces of the protection walls 130. However, this might cause the receptacle 114 to be deformed due to sinks in the process of molding the male housing 110. The ribs 118 avoid the need to thicken the receptacle 114. Thus, sinks will not be created during molding of the receptacle 114.

Figure 17:
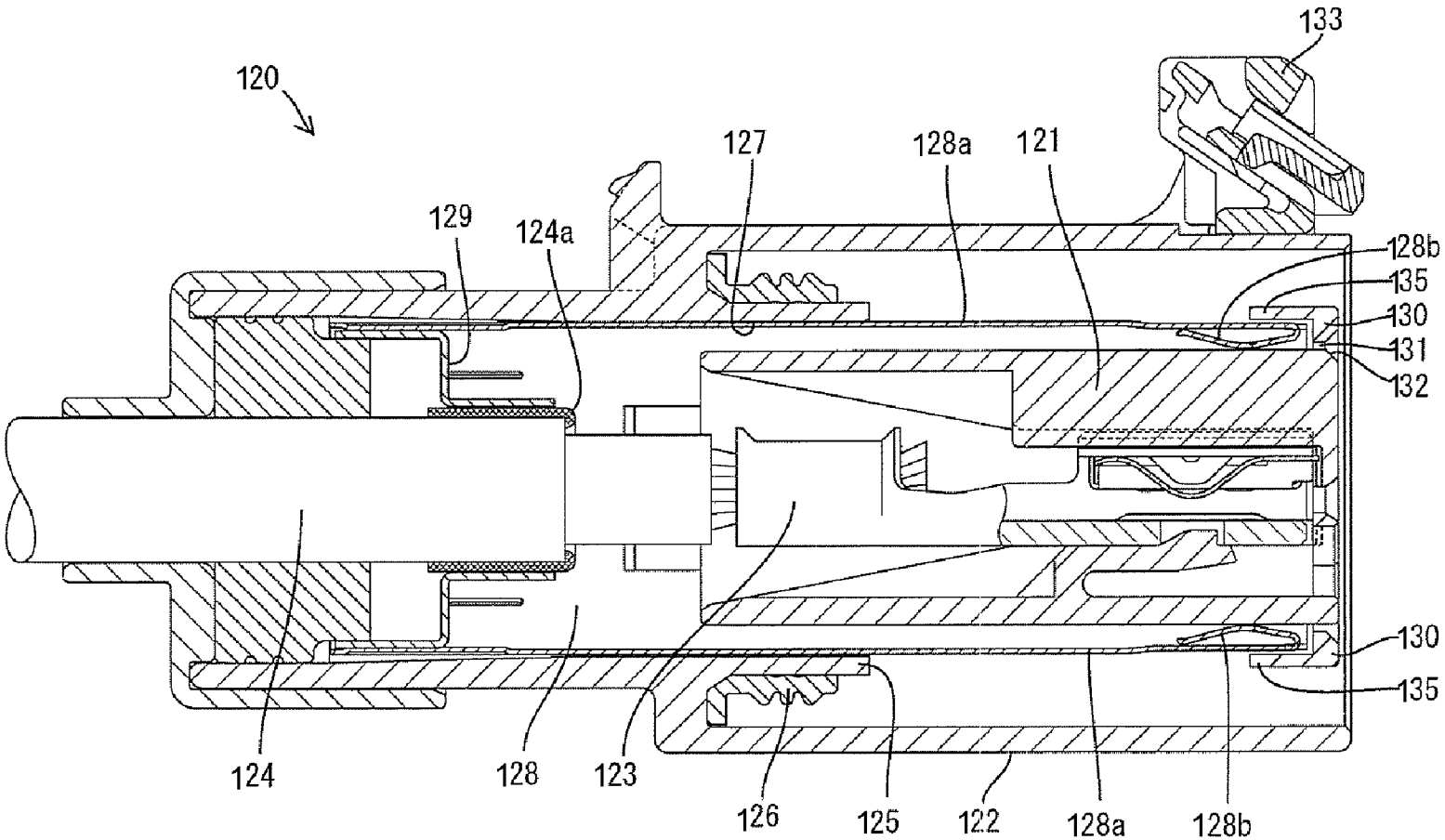
FIG. 17 is a section showing a state where two male and female housings are connected in a third embodiment.
Figure 18:
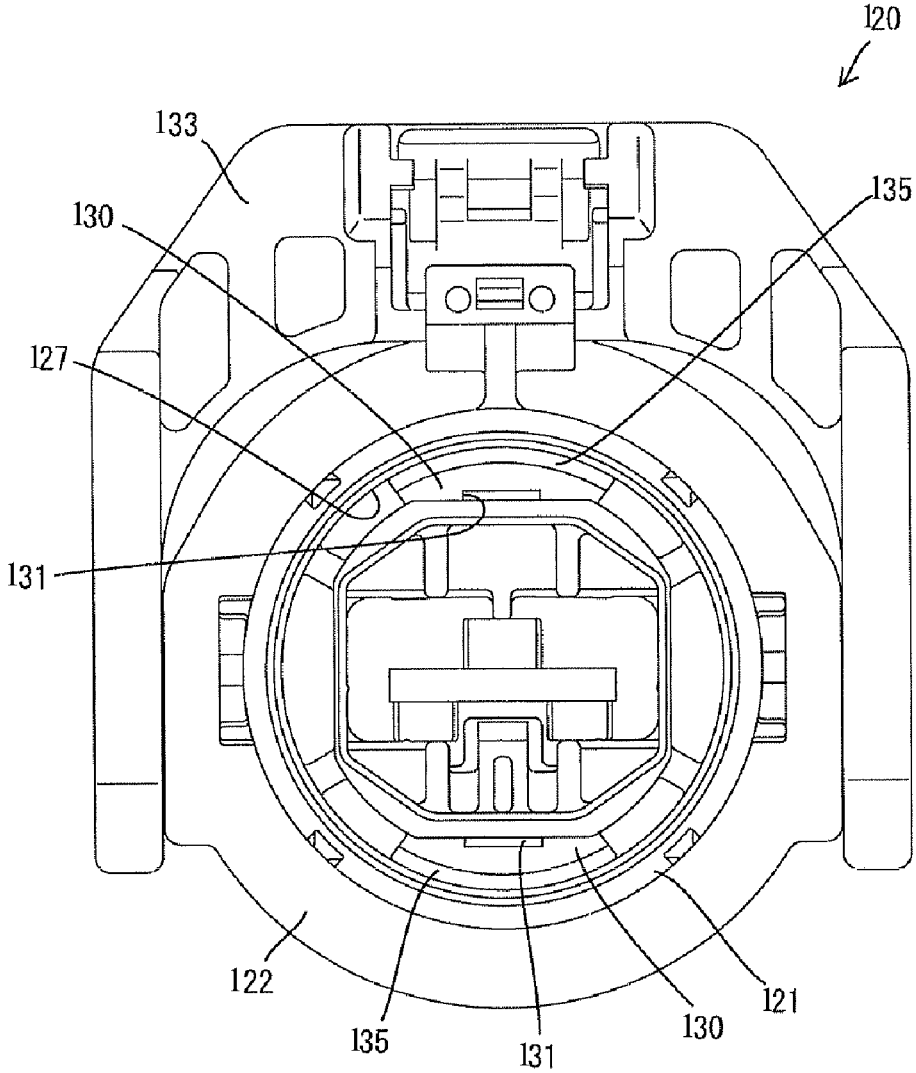
FIG. 18 is a rear view of the female housing.

A third embodiment of the invention is described with reference to FIGS. 17 and 18. In the third embodiment, each protection wall 130 of the second embodiment is formed with a pushing portion 135. Other elements are the same as or similar to the second embodiment. These same or similar elements are identified by the same reference numerals, but are not described again.

Each pushing portion 135 projects back in an overhanging or undercut manner from the outer circumferential end edge of the protection wall 130 over substantially the entire width of the protection wall 130 to form an arcuate rib concentric with the outer circumferential surface of the terminal accommodating portion 121. The outer circumferential surface of the front end portion of the female shielding shell 128 (i.e. part formed with the contact portions 128*b* with the male shielding shell 116) contacts the inner circumferential surfaces of the pushing portions 135 substantially in radial directions. The pressing portions 135 contact the contact portions 128*b* of the female shielding shell 128 to prevent radially outward escaping displacements. Thus, a sufficient contact pressure can be ensured between the inner circumferential surface of the female shielding shell 128 and the male shielding shell 116. Further, the ribs 118 of the receptacle 114 can slide in contact with the outer circumferential surfaces of the pushing portions 135.

Figure 19:
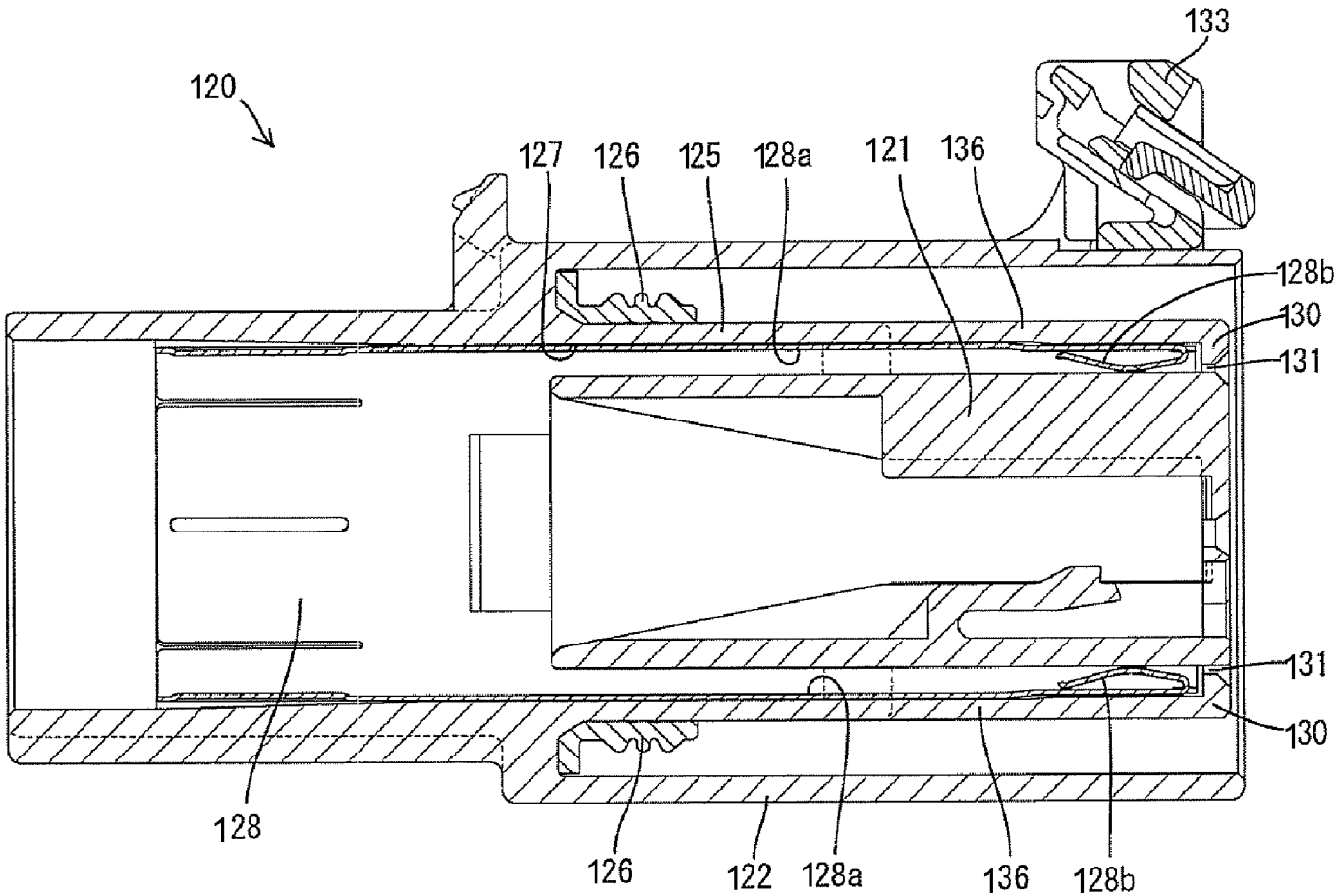
FIG. 19 is a section of a female housing according to a fourth embodiment.

A fourth embodiment of the invention is described with reference to FIG. 19. Pushing portions 136 of the fourth embodiment are extended more backward than the pushing portions 135 of the third embodiment so that the outer circumferential surfaces thereof become substantially continuous and flush with outer circumferential surfaces of the surrounding portion 125 on which the seal 126 is to be mounted. Other elements are the same as or similar to the third embodiment. Those identical or similar elements are not described again, but merely are identified by the same reference numerals.

Areas of the female touching pieces 128*a* of the female shielding shell 128 corresponding to the terminal accommodating portion 121 in forward and backward directions are covered in the fourth embodiment. Thus, the interference of the receptacle 114 and the female touching pieces 128*a* is prevented reliably.

Figure 20:
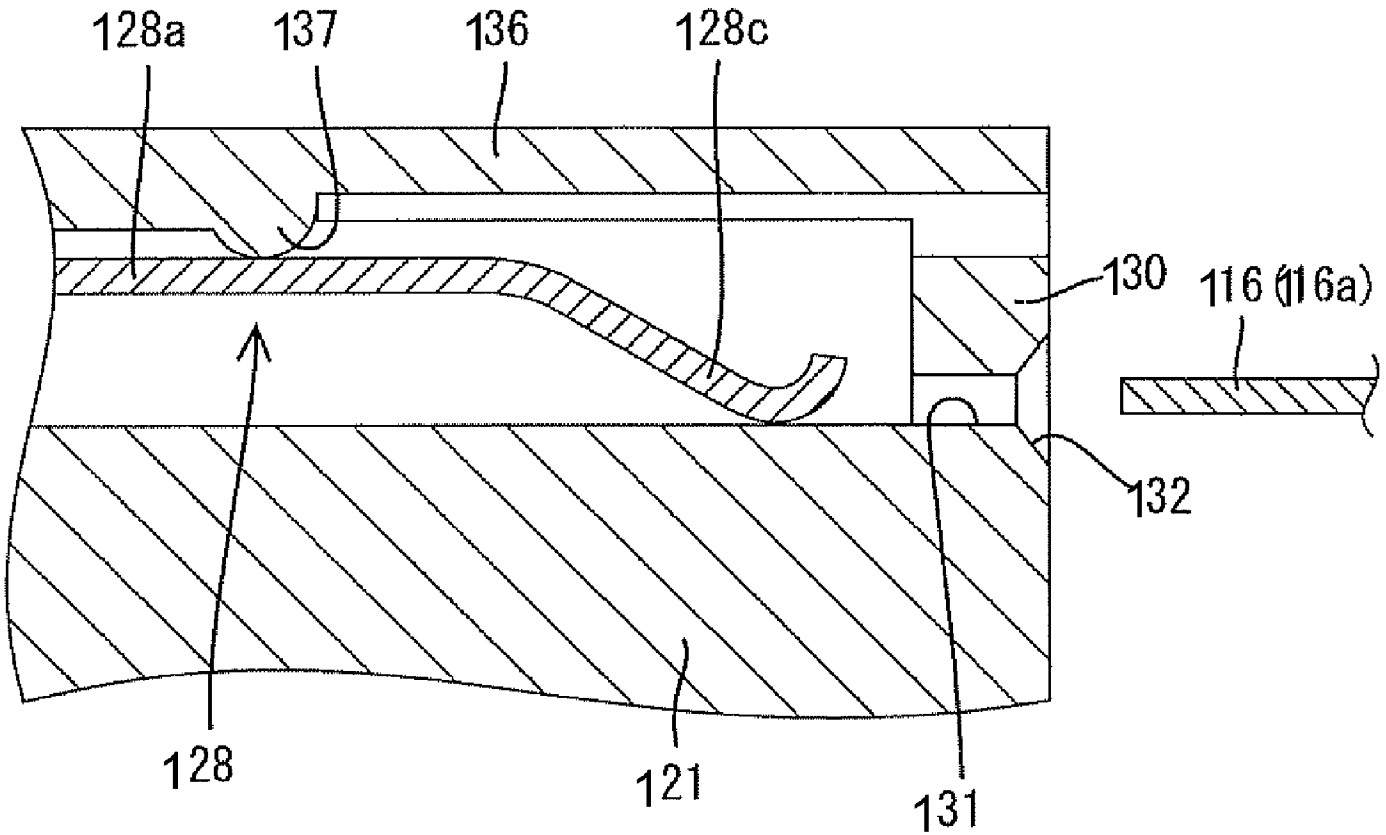
FIG. 20 is a partial enlarged section showing a state where a male shielding shell and a female shielding shell are not in contact in a fifth embodiment.
Figure 21:
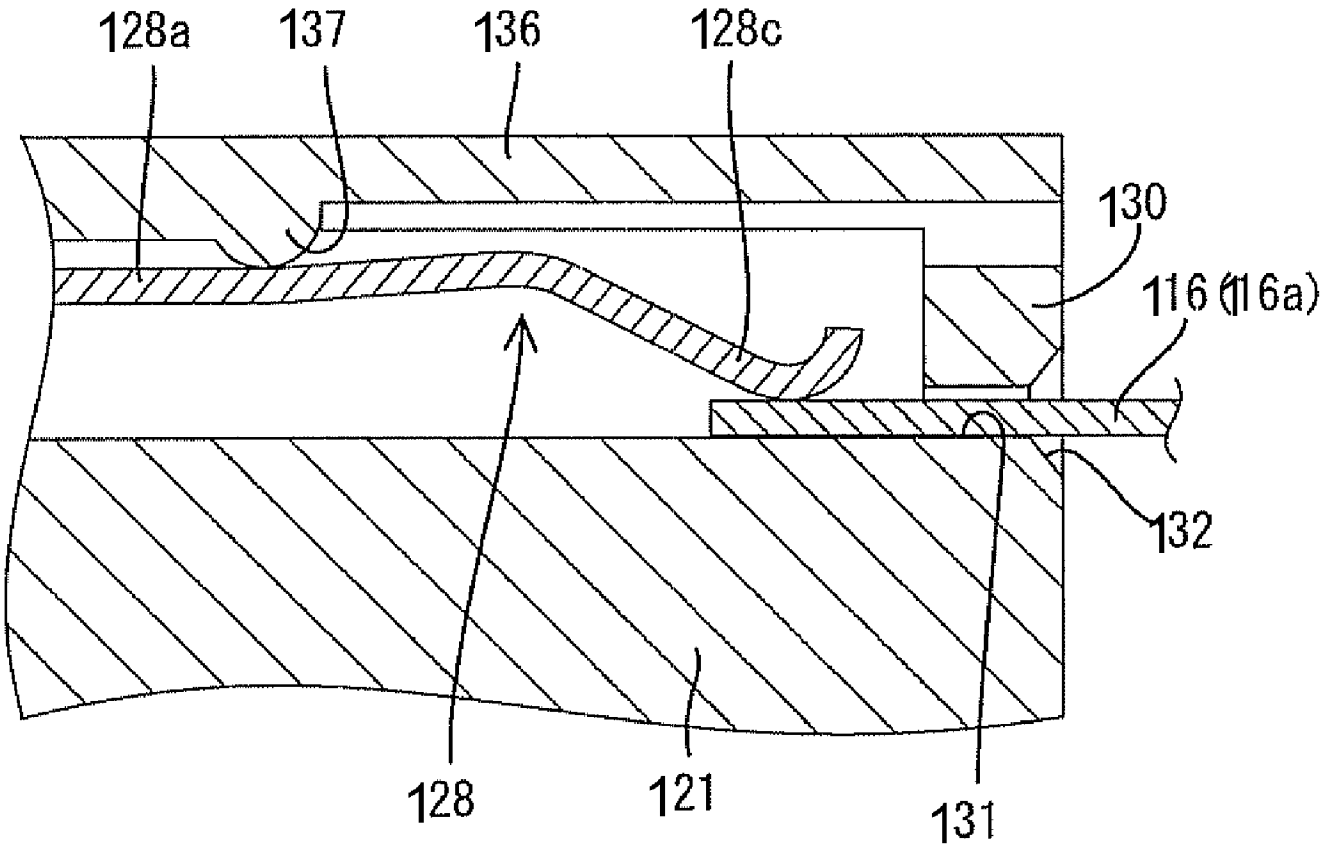
FIG. 21 is a partial enlarged section showing a state where the male and female shielding shells are in contact.

A fifth embodiment of the invention is described with reference to FIGS. 20 and 21. Contact portions 128*c* of the fifth embodiment differ from the contact portions 128*b* of the female touching pieces 128*a* of the fourth embodiment in shape. Other elements are the same as or similar to the fourth embodiment. Those identical or similar elements are not described again, but merely are identified by the same reference numerals.

A contact portion 128*c* is formed at the front end of the female contact portion 128*a*. The contact portion 128*c* extends forward from the inner circumferential surface of the pushing portion 136 and in towards the outer circumferential surface of the terminal accommodating portion 121. Further, a substantially semispherical support 137 projects from the inner circumferential surface of each pushing portion 136 slightly behind the rear end of the contact portion 128*c*. The outer circumferential surface of the corresponding female touching piece 128*a* contacts the support 137. The contact portions 128*c* resiliently contact the outer circumferential surface of the terminal accommodating portion 121 unless the female shielding shell 128 is in contact with the male shielding shell 116.

The male shielding shell 116 can be inserted beyond the protection walls 130 and into the clearance between the female shielding shell 128 and the terminal accommodating portion 121. Thus, areas of the female touching pieces 128 before the supports 137 (i.e. including the contact portions 128*c*) are deformed resiliently about the supports 137 and incline towards the outer circumferential surface of the terminal accommodating portion 121. A distance from the supports 137 of resilient deformations to the contact portions 128*c* with the male shielding shell 116 is stable when the female touching pieces 128*a* are deformed. Thus, the amounts of resilient deformation of the female touching pieces 128*a*, i.e. resilient contact pressures of the contact portions 128*c* against the male shielding shell 116 is stable.

Figure 22:
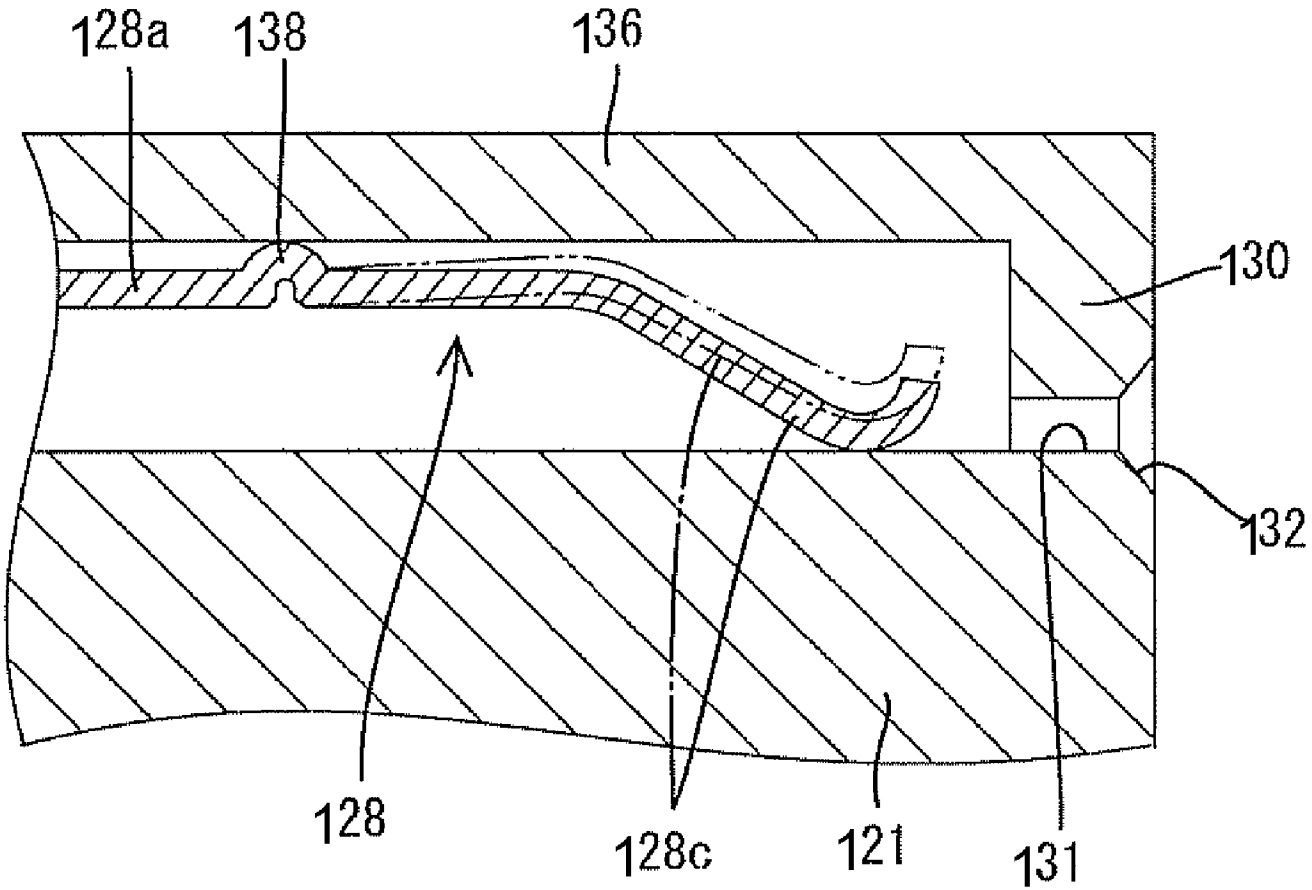
FIG. 22 is a partial enlarged section of a sixth embodiment.

A sixth embodiment of the invention is described with reference to FIG. 22. Supports 138 of the sixth embodiment differ from those of the fifth embodiment in their form. Other elements are the same as or similar to the fifth embodiment. Those identical or similar elements are not described again, but merely are identified by the same reference numerals.

The supports 137 are formed on the inner circumferential surfaces of the pushing portions 136 in the fifth embodiment. However, the supports 138 of the sixth embodiment project out on the female touching pieces 128*a*. The supports 138 are substantially semispherical projections arranged behind the rear ends of the contact portions 128*c*. The supports 138 contact the inner circumferential surfaces of the pushing portions 136 and the front ends of the contact portions 128*c* resiliently contact the outer circumferential surface of the terminal accommodating portion 121 unless the female shielding shell 128 is in contact with the male shielding shell 116.

The invention is not limited to the above described and illustrated embodiments. For example, the following embodiments are also embraced by the technical scope of the present invention as defined by the claims.

Two outer touching pieces and two inner touching pieces are provided in the first embodiment. However, more or fewer touching pieces may be provided.

Only the outer touching pieces have the resilient touching pieces in the first embodiment. However, the resilient touching pieces may be provided only on the inner touching pieces or on both the outer and inner touching pieces.

Although the outer touching pieces are arcuate in the first embodiment, they may be plate-like according to the invention.

Although the inner touching pieces are plate-like in the first embodiment, they may be curved according to the invention.

The protection walls may be formed so that their front surfaces are more backward than the front end surface of the terminal accommodating portion.

The protection walls may be parts separate from the terminal accommodating portion.

The outer surfaces of the protection walls and the inner surface of the receptacle may not be in contact during the connection process.

The inner surface of the receptacle and the outer surface of the female shielding shell may not be in contact when the housings are connected.

The thickness of the receptacle may be increased for contacting the protection walls instead of forming the ribs.

What is claimed is:

1. A shielded connector, comprising:

a male housing;

a female housing connectable with the male housing; and two substantially identical shielding shells mounted respectively to the male and female housings, leading ends of the shielding shells having touching portions that include at least one outer touching piece with a contact point at an inner circumferential side and at least one inner touching piece with a contact point at an outer circumferential side, the shielding shells being oriented circumferentially in the male and female housings so that the contact point of the outer touching piece of the male housing contacts the contact point of the inner touching piece of the female housing and so that the contact point of the inner touching piece of the male housing contacts the contact point of the outer touching piece of the female housing for shielding an electrically conducting path in the male and female housings.

2. The shielded connector of claim 1, wherein the at least one outer touching piece comprises two outer touching pieces and the at least one inner touching piece comprises two inner touching pieces, the inner and outer touching pieces being arranged alternately at intervals of about 90°.

3. The shielded connector of claim 1, wherein the touching portion of the shielding shell of the male housing projects forward from a surface of the male housing substantially facing the female housing and is at least partly surrounded by a receptacle formed on the male housing.

4. The shielded connector of claim 1, wherein slits are formed between the inner and outer touching pieces so that the inner touching pieces are resiliently deformable in radial directions independently of the outer touching pieces.

5. The shielded connector of claim 3, wherein at least one rib is formed on the inner circumferential surface of the receptacle and extends along the outer surface of the outer touching piece.

6. The shielded connector, comprising:

a male housing having a receptacle with an inner circumferential surface;

a female housing having a terminal accommodating portion with an outer circumferential surface, the terminal accommodating portion being fit in the receptacle so that a clearance is defined between the outer circumferential surface of the terminal accommodating portion and the inner circumferential surface of the female shielding shell, at least one protection wall located substantially at a front end of the female housing, the protection wall being formed with at least one insertion hole;

a female shielding shell extending along the outer circumferential surface of the terminal accommodating portion of the female housing rearward of the protection wall;

a male shielding shell substantially identical to the female shielding shell, the male shielding shell being provided in the clearance between the outer circumferential surface of the terminal accommodating portion and the inner circumferential surface of the female shielding shell, and at least a portion of the male shielding shell being insertable through the insertion hole.

7. The shielded connector of claim 6, wherein the protection wall has an outer circumferential surface held substantially in sliding contact with the inner circumferential surface of the receptacle in the process of connecting the male and female housings.

8. The connector of claim 6, wherein leading ends of the shielding shells having at least one outer touching piece with a contact point at an inner circumferential side and at least one inner touching piece with a contact point at an outer circumferential side, the shielding shells being oriented circumferentially in the male and female housings so that the contact point of the outer touching piece of the male shielding contacts the contact point of the inner touching piece of the female shielding shell and so that the contact point of the inner touching piece of the male shielding contacts the contact point of the outer touching piece of the female shielding shell for shielding an electrically conducting path in the male and female housings when the housings are connected.

9. The shielded connector of claim 8, wherein the inner circumferential surface of the receptacle and the outer circumferential surface of the female shielding shell are held in contact substantially in radial directions with the male and female housings connected.

10. The shielded connector of claim 9, wherein at least one seal is mounted on the terminal accommodating portion at a position behind a contact position of the female shielding shell and the male shielding shell and more radially outward than the outer circumferential surface of the protection wall, and at least one rib disposed at a position of the inner circumferential surface of the receptacle behind a close contact position with the seal for sliding contact with the outer circumferential surface of the protection wall.

11. The shielded connector of claim 10, wherein:

a front end portion of the female shielding shell serves as a contact portion with the male shielding shell, and the protection wall is formed with at least one pushing portion disposed for contacting the outer circumferential surface of a front end portion of the female shielding shell.

12. First and second substantially identical tubular shielding shells, each of said tubular shielding shells having a leading end, plural outer touching pieces equally spaced circumferentially from one another at the leading end of each of the shielding shells and plural inner touching pieces arranged circumferentially between the outer touching pieces and being equally spaced circumferentially from one another, each of outer touching pieces having a contact point at a radially inner side and each of the inner touching pieces having a contact point at a radially outer side, the shielding shells being oriented so that the leading ends face one another and the shielding shells being oriented circumferentially so that inner touching pieces of one shielding shell oppose the outer touching pieces of the other shielding, the inner and outer touching pieces being disposed and configured so that the contact points of the outer touching pieces are resiliently engageable with the contact points of the inner touching pieces so that the shields produce a continuous shield along their lengths.

13. The shields of claim 12, wherein slits are formed between the inner and outer touching pieces so that the inner touching pieces are resiliently deformable directions independently of the outer touching pieces.

14. The shields of claim 12, wherein each shield is formed unitarily of a conductive metal.

* * * * *